US007368069B2

(12) United States Patent
Tosaka et al.

(10) Patent No.: US 7,368,069 B2
(45) Date of Patent: May 6, 2008

(54) PTC THERMISTOR

(75) Inventors: Hisanao Tosaka, Yuri-gun (JP); Yasuhide Yamashita, Yuri-gun (JP)

(73) Assignee: TDK Corporation, Tokyo (JP)

( * ) Notice: Subject to any disclaimer, the term of this patent is extended or adjusted under 35 U.S.C. 154(b) by 368 days.

(21) Appl. No.: 10/503,618

(22) PCT Filed: Feb. 7, 2003

(86) PCT No.: PCT/JP03/01300

§ 371 (c)(1),
(2), (4) Date: Nov. 10, 2004

(87) PCT Pub. No.: WO03/067613

PCT Pub. Date: Aug. 14, 2003

(65) Prior Publication Data

US 2005/0116808 A1 Jun. 2, 2005

(30) Foreign Application Priority Data

Feb. 8, 2002 (JP) ..... 2002-032906

(51) Int. Cl.
*H01B 1/22* (2006.01)

(52) U.S. Cl. ..... 252/511; 252/512; 252/513; 252/518.1; 252/521.2; 338/22 R

(58) Field of Classification Search ..... 252/511, 252/512, 513, 518.1, 521.2; 338/22 R
See application file for complete search history.

(56) References Cited

U.S. PATENT DOCUMENTS 5,582,770 A * 12/1996 Chu et al. ..... 252/511
5,747,147 A * 5/1998 Wartenberg et al. ..... 428/209
5,945,034 A * 8/1999 Handa et al. ..... 252/511
6,299,801 B1 * 10/2001 Handa et al. ..... 252/511
6,348,852 B1 * 2/2002 Kojima et al. ..... 338/22 R
2002/0145130 A1 * 10/2002 Handa et al. ..... 252/500

FOREIGN PATENT DOCUMENTS

| | | |
|---|---|---|
| JP | A 63-184303 | 7/1988 |
| JP | A 4-28743 | 5/1992 |
| JP | A 6-89802 | 3/1994 |
| JP | A 09-153402 | 6/1997 |
| JP | A 10-214705 | 8/1998 |
| JP | A 11-168005 | 6/1999 |
| JP | A 2000-82602 | 3/2000 |
| JP | A 2000-124003 | 4/2000 |
| JP | A 2000-133502 | 5/2000 |
| JP | A 2000-133503 | 5/2000 |
| JP | A 2001-52901 | 2/2001 |
| JP | A 2001-102203 | 4/2001 |

* cited by examiner

*Primary Examiner*—Mark Kopec
*Assistant Examiner*—Tri V. Nguyen
(74) *Attorney, Agent, or Firm*—Oliff & Berridge, PLC

(57) ABSTRACT

In a PTC thermistor comprising at least a pair of electrodes disposed so as to face each other and a thermistor element disposed between the electrodes and having a positive resistance-temperature characteristic, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the high molecular matrix is an olefin-type high molecular compound having a melting start temperature of between 85 and 95° C.

22 Claims, 12 Drawing Sheets

PTC THERMISTOR

TECHNICAL FIELD

The present invention relates to a PTC (Positive Temperature Coefficient) thermistor and a manufacturing method for a PTC thermistor. More specifically, the present invention relates to a PTC thermistor comprising a thermistor element disposed between a pair of electrodes, the thermistor element being constituted by a molded body containing polymeric material and conductive particles as constitutional materials, and a manufacturing method for the PTC thermistor. The PTC thermistor of the present invention (and the PTC thermistor obtained according to the PTC thermistor manufacturing method of the present invention) may be used favorably as a temperature sensor and an overcurrent protection element (for example, an overcurrent protection element in a lithium ion battery).

BACKGROUND ART

A PTC (Positive Temperature Coefficient) thermistor comprises at least a pair of electrodes disposed so as to face one another, and a thermistor element disposed between the pair of electrodes. The thermistor element has a "positive resistance-temperature characteristic" according to which the resistance value of the thermistor element increases rapidly with increasing temperature in a fixed temperature range.

A PTC thermistor employs this characteristic to protect the circuits of electronic devices such as self-regulating heaters, temperature sensors, current-limiting elements, overcurrent protection elements, and so on, for example. For use in these and other applications, demands are being made for PTC thermistors having a low room temperature resistance value when inoperative, a large rate of change between the room temperature resistance value when inoperative and the resistance value when operative, little variation in the resistance value when operated repeatedly (i.e. a small difference between the resistance value upon an initial stage of usage and the resistance value after repeated usage), an excellent cutoff characteristic, and an element with a low heat generation temperature. Demands are also being made for small size, light weight, and low cost.

A typical PTC thermistor is loaded with a thermistor element constituted by a ceramic material. However, this type of PTC thermistor has a poor cutoff characteristic and a thermistor element with a high heat generation temperature, and is difficult to reduce in size, weight, and cost. Particularly when used as an overcurrent protection element for a battery such as a lithium ion battery, the operating temperature of the PTC thermistor is preferably no more than 100° C., and more preferably between 80 and 95° C., but it is difficult for this type of PTC thermistor to satisfy such an operating temperature.

In response to such demands for a lower operating temperature and so on, a PTC thermistor (to be referred to where necessary as a "P-PTC thermistor" hereinafter) comprising a molded body constituted by a thermoplastic resin (high molecular matrix) and conductive particles as a thermistor element is under investigation.

An example of such a P-PTC thermistor, loaded with a thermistor element formed using low-density polyethylene as the high molecular matrix and nickel powder as the conductive particles (conductive filler) has been proposed (for example, in Japanese Unexamined Patent Application Publication H11-168005). This P-PTC thermistor is intended to have a comparatively low operating temperature (no more than 100° C., and preferably between 80 and 95° C.).

DISCLOSURE OF THE INVENTION

However, the present inventors have discovered that conventional P-PTC thermistors, including the P-PTC thermistor described in Japanese Unexamined Patent Application Publication H11-168005, do not satisfy the electrical characteristic conditions required when operated repeatedly at an operating temperature of no more than 100° C., and preferably between 80 and 95° C., and hence sufficient reliability is yet to be obtained.

PTC thermistors are required to have an electrical characteristic whereby a resistance value after an operation {measured at room temperature (25° C.)} which is substantially equally as low as the initial usage stage resistance value {measured at room temperature (25° C.)} can be realized continuously, even after at least a predetermined number of repeated temperature-raising and temperature-lowering operations (reliability over repeated operations). Since the power consumption of the PTC thermistor increases as the resistance value rises, this is a particular problem when the electronic device that is loaded with the PTC thermistor is a small device such as a portable telephone.

The number of temperature-raising and temperature-lowering cycles varies according to the performance and lifespan required of the electronic device (a portable telephone, for example) into which the PTC thermistor is loaded as a temperature sensor, overcurrent protection element for the power source (a lithium ion secondary battery, for example), and so on. However, this electrical characteristic of the PTC thermistor (reliability over repeated operations) can usually be evaluated using as a reference (index) a resistance value {measured at room temperature (25° C.)} measured by means of a "thermal shock test" performed in accordance with the provisions of JIS C 0025 or MIL-STD-202F 107.

This "thermal shock test" is performed on a PTC thermistor by repeating a single thermal processing cycle comprising the following steps (i) through (iv) two hundred times, and then measuring the resistance value {measured at room temperature (25° C.)}. A single thermal processing cycle comprises the steps of (i) holding the PTC thermistor for thirty minutes under a temperature condition in which the temperature of the thermistor element loaded in the PTC thermistor is −40° C., (ii) raising the temperature of the thermistor element to 85° C. within 10% of this holding time (three minutes), (iii) holding the PTC thermistor for thirty minutes under a temperature condition in which the temperature of the thermistor element is 85° C., and (iv) lowering the temperature of the thermistor element to −40° C. within 10% of this holding time (three minutes).

The present inventors discovered that in the case of a "P-PTC thermistor" used in a usage environment in which the operating temperature is no more than 100° C. (preferably between 80 and 95° C.), the thermistor may be evaluated as possessing reliability over repeated operations at an operating temperature of no more than 100° C. providing the resistance value measured after this thermal shock test {measured at room temperature (25° C.)} is no more than 0.03Ω.

The present inventors then discovered that in conventional P-PTC thermistors, including the P-PTC thermistor described in the aforementioned Patent Document 1, the resistance value following a thermal shock test cannot be held to no more than 0.03Ω, and hence that sufficient reliability is not obtained over repeated operations. The present inventors also determined that since the resistance value of a conventional P-PTC thermistor following a thermal shock test cannot beheld to 0.03Ω or less, power consumption during an operation increases, and hence it is difficult to use a conventional P-PTC thermistor repeatedly when loaded in an electronic device. It is particularly difficult to use a conventional P-PTC thermistor as an overcurrent protection element for a power source such as a lithium ion secondary battery for a portable telephone.

The present invention has been designed in consideration of these problems in the prior art, and it is an object thereof to provide a PTC thermistor having excellent reliability, in which the resistance value obtained after a thermal shock test is no more 0.03Ω, and the resistance value obtained during an initial stage of usage can be maintained sufficiently even after repeated operations at an operating temperature of no more than 100° C. A further object of the present invention is to provide a manufacturing method for a PTC thermistor according to which a PTC thermistor having the characteristics described above, and hence having excellent reliability, can be constructed easily and securely.

As a result of much committed research aimed at achieving these objects, the present inventors discovered that when a thermistor element is formed from a molded body constituted by a high molecular matrix, a low molecular organic compound, and a conductive particle having electric conductivity, the following items are extremely effective in achieving the aforementioned objects: (I) the thermistor element contains a high molecular matrix having a melting start temperature within a specific range; (II) the thermistor element contains a high molecular matrix having a density within a specific range; (III) the thermistor element contains a high molecular matrix having a coefficient of linear expansion within a specific range; (IV) the thermistor element contains a low molecular organic compound having a penetration within a specific range; (V) the thermistor element contains a low molecular organic compound having a branching ratio sum within a specific range; (VI) the thermistor element is formed using a high molecular matrix and a low molecular organic compound having a melting point difference within a specific range; and (VII) the thermistor element contains nickel particles having a specific shape and a specific surface area within a specific range.

The present inventors then discovered that by constructing a PTC thermistor comprising a thermistor element which satisfies at least one of these conditions (I) through (VII), then the aforementioned objects can be achieved. Thus the inventors arrived at the present invention.

The present invention provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the high molecular matrix is an olefin-type high molecular compound having a melting start temperature between 85 and 95° C.

As described above, a high molecular matrix (in this case, an olefin-type high molecular compound) having a melting start temperature in a range of 85 to 95° C. is contained in the thermistor element, and hence a thermistor element which can be loaded into a PTC thermistor having an operating temperature between 80 and 100° C. can be constructed easily and reliably. Moreover, this type of PTC thermistor (to be referred to as "PTC thermistor (I)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (I) is capable of achieving excellent reliability.

In the present invention, the "operating temperature" of the PTC thermistor indicates the surface temperature of apart of the electrode surface which is in a state of thermal equilibrium with the thermistor element of the PTC thermistor during electric conduction. More specifically, the operating temperature indicates the surface temperature of this part of the electrode surface 100 seconds after a short circuit current is caused to flow between the pair of electrodes of the PTC thermistor following the application of a 6V voltage.

In this specification, the "melting start temperature" of the high molecular matrix is a temperature defined as follows using a DSC curve obtained upon analysis by means of differential scanning calorimetry (DSC) using the high molecular matrix as a test sample.

That is, in a DSC curve obtained by raising the temperature of a test sample and a reference material from room temperature (25° C.) at a fixed rate of temperature increase (2° C./min), the melting start temperature is indicated by the intersecting point between a tangent of a point of inflection appearing at the lowest temperature side of a first endothermic peak and a baseline {a straight line which passes through the measuring start point, indicates a differential scanning calorific value of approximately 0 mW, and is parallel to the temperature axis (abscissa)} (see FIGS. 2, 3 to be described below). Note that in the present invention, $\alpha$-$Al_2O_3$ powder is used as the reference material (a thermally stable substance) in the differential scanning calorimetry described above.

Further, in this specification, "thermal shock test" indicates a test performed in accordance with the aforementioned provisions of JIS C 0025, in which a single thermal processing cycle comprising the aforementioned steps (i) through (iv) is performed on the PTC thermistor 200 times, and the resulting resistance value {measured at room temperature (25° C.)} is measured. Devices having the product names "TSE-11-A" and "TSA-71H-W", manufactured by ESPEC CORP., are used as the devices for performing the thermal shock test.

In the PTC thermistor (I) of the present invention, if the melting start temperature of the high molecular matrix is less than 85° C., then the resistance value following the thermal shock test exceeds 0.03Ω. If the melting start temperature of the high molecular matrix exceeds 95° C., then the operating temperature exceeds 100° C. Furthermore, if the melting start temperature exceeds 95° C., then the resistance value following the thermal shock test exceeds 0.03Ω.

Further, in the PTC thermistor (I) of the present invention {and also the PTC thermistors (II) through (VII) to be described below}, if the molecular weight (number average molecular weight) of the high molecular matrix is less than 10,000, the operating temperature becomes too low, and hence the target operating temperature (no more than 100° C., and preferably between 80 and 95° C.) cannot be secured. In this case, if the PTC thermistor is used as an overcurrent protection element for a lithium ion secondary battery serving as the power source of a portable device such as a portable telephone, for example, then the PTC thermistor operates in normal, low-temperature regions.

Moreover, in the PTC thermistor (I) of the present invention {and also the PTC thermistors (II) through (VII) to be described below}, if the molecular weight (number average molecular weight) of the high molecular matrix exceeds 400,000, the operating temperature becomes too high, and hence the target operating temperature (no more than 100° C., and preferably between 80 and 95° C.) cannot be secured. In this case, if the PTC thermistor is used as an overcurrent protection element for a lithium ion secondary battery serving as the power source of a portable device such as a portable telephone, for example, then the PTC thermistor only operates in irregular high-temperature regions, causing defects in the electronic components of the device such as the lithium ion secondary battery. In consideration of these points, the molecular weight (number average molecular weight) of the high molecular matrix in the PTC thermistor (I) of the present invention {and the PTC thermistors (II) through (VII) to be described below} is set between 10,000 and 400,000, and preferably between 100,000 and 200,000.

Further, in the PTC thermistor (I) of the present invention {and also the PTC thermistors (II) through (VII) to be described below}, if the molecular weight (number average molecular weight) of the low molecular organic compound is less than 100, the thermistor element softens even at room temperature, thus becoming more likely to deform, with the result that the resistance value following the thermal shock test at the target operating temperature (no more than 100° C., and preferably between 80 and 95° C.) exceeds 0.03Ω.

Moreover, in the PTC thermistor (I) of the present invention {and also the PTC thermistors (II) through (VII) to be described below}, if the molecular weight (number average molecular weight) of the low molecular organic compound exceeds 3,000, the operating temperature becomes too high, and hence the target operating temperature (no more than 100° C., and preferably between 80 and 95° C.) cannot be secured. In consideration of these points, the molecular weight (number average molecular weight) of the low molecular organic compound in the PTC thermistor (I) of the present invention {and the PTC thermistors (II) through (VII) to be described below} is set between 100 and 3,000, and preferably between 500 and 1,000.

In this specification, "olefin-type high molecular compound" denotes a high molecular compound having at least one ethylenic unsaturated bond (an ethylenic double bond) in the molecule.

The present invention also provides a PTC thermistor comprising at least a pair of electrodes disposed so as to face each other and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the density of the high molecular matrix is between 920 and 928 kg/m$^3$.

As described above, a high molecular matrix having a density in a range of 920 to 928 kg/m$^3$ is contained in the thermistor element, and hence a thermistor element which can be loaded into a PTC thermistor having an operating temperature between 80 and 100° C. can be constructed easily and reliably. Moreover, this type of PTC thermistor (to be referred to as "PTC thermistor (II)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (II) is capable of achieving excellent reliability.

It is known that temperature variation due to the repeated heating and cooling performed during a thermal shock test typically causes the proportion and structure of the noncrystalline portions of the high molecular matrix to vary greatly from their original states. The present inventors conjecture that this variation in the proportion and structure of the noncrystalline portions of the high molecular matrix influences the resistance value following a thermal shock test. Since a high molecular matrix with a comparatively high density in the aforementioned range has a comparatively high crystallinity and a small proportion of noncrystalline portions in its initial state, the present inventors conjecture that such a high molecular matrix has a stable constitution in which variation in the proportion and structure of the noncrystalline portions can be suppressed even when subjected to temperature variation due to the repeated heating and cooling that is performed during the thermal shock test. Hence the present inventors conjecture that the PTC thermistor (II) loaded with the thermistor element containing a high molecular matrix with a density in the aforementioned range is able to obtain a resistance value of no more than 0.03Ω following the thermal shock test.

In the PTC thermistor (II) of the present invention, if the density of the high molecular matrix falls below 920 kg/m$^3$, the resistance value following the thermal shock test exceeds 0.03Ω. If the density of the high molecular matrix exceeds 928 kg/m$^3$, the melting point rises, causing the operating temperature to exceed 100° C. such that the effects of the present invention cannot be obtained.

The present invention also provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the coefficient of linear expansion of the high molecular matrix is between $1.00\times10^{-4}$ and $5.43\times10^{-4}$.

In this specification, the "coefficient of linear expansion" of the high molecular matrix is a value measured at a temperature (preferably between 25 and 80° C.) below the "melting start temperature" of the high molecular matrix.

As described above, a high molecular matrix having a linear expansion coefficient within a range of $1.00\times10^{-4}$ to $5.43\times10^{-4}$ is contained in the thermistor element, and hence a thermistor element which can be loaded into a PTC thermistor having an operating temperature of between 80 and 100° C. can be constructed easily and reliably. Moreover, this type of PTC thermistor (to be referred to as "PTC thermistor (III)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (III) is capable of achieving excellent reliability.

The present inventors decided to incorporate a high molecular matrix having a linear expansion coefficient within the aforementioned range in the thermistor element as a result of investigations into the influence of the linear expansion coefficient of the polyethylene serving as the high molecular matrix on the resistance value following a thermal shock test, taking into consideration the fact that when a thermal shock test is performed, the difference in the linear expansion coefficients of the conductive particles and high molecular matrix contained in the thermistor element generates internal stress in the high molecular matrix, as a result of which deformation occurs in minute partial regions of the thermistor element, causing the resistance value to rise. By incorporating a high molecular matrix having a comparatively small linear expansion coefficient within the aforementioned range into the thermistor element, increases in the resistance value following the thermal shock test can be reduced sufficiently.

In the PTC thermistor (III) of the present invention, if the linear expansion coefficient of the high molecular matrix falls below $1.00\times10^{-4}$, the melting point rises, causing the operating temperature to exceed 100° C. such that the effects of the present invention cannot be obtained. If the linear expansion coefficient of the high molecular matrix exceeds $5.43\times10^{-4}$, the resistance value following the thermal shock test exceeds 0.03Ω.

The present invention also provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the penetration of the low molecular organic compound at 25° C. is between 0.5 and 6.5.

As described above, a low molecular organic compound having a penetration at 25° C. within a range of 0.5 to 6.5 is contained in the thermistor element, and hence a thermistor element which can be loaded into a PTC thermistor having an operating temperature of between 80 and 100° C. can be constructed easily and reliably. Moreover, this type of PTC thermistor (to be referred to as "PTC thermistor (IV)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (IV) is capable of achieving excellent reliability.

In this specification, the "penetration" of the low molecular organic compound at 25° C. indicates a value determined by penetration measurement according to the provisions in JIS K-2235-5.4. Penetration measurement is a method of measuring the hardness of a sample (in this case, a sample constituted by the low molecular organic compound). In this method, the tip end of a needle having a prescribed weight is caused to penetrate the sample vertically at a prescribed temperature while a 100 g load is placed on the needle. The hardness of the sample is expressed by the length of the part of the sample which the needle penetrates. More specifically, a length Z [mm] of the sample that is penetrated by the tip end part of the needle in five seconds is determined, and the penetration is expressed as a numerical value obtained by multiplying Z by ten (10Z). Hence 1/10 mm indicates a penetration of one, and a larger numerical value indicates a softer material.

Conventionally, a low molecular organic compound having a penetration of between 8 and 35 (measurement data based on ASTM D1321) is used in P-PTC thermistors. However, the present inventors discovered that even when the molecular weight of the low molecular organic compound is approximately identical, the penetration greatly influences the resistance value following a thermal shock test. Moreover, the present inventors discovered that when a low molecular organic compound having a penetration in a range of 0.5 to 6.5 as described above, which is much harder than the conventional low molecular organic compound, is incorporated into the thermistor element, the resistance value following the thermal shock test can be held to or below 0.03Ω easily. When the thermistor element contains a low molecular organic compound having a penetration within a range of 0.5 to 6.5, the low molecular organic compound content of the thermistor element is preferably between 3 and 35 volume percent of the thermistor element volume.

In the PTC thermistor (IV) of the present invention, it is extremely difficult to obtain a low molecular organic compound having a penetration at 25° C. of less than 0.5 with stability. If the penetration at 25° C. of the low molecular organic compound exceeds 6.5, the resistance value following the thermal shock test exceeds 0.03Ω. In consideration of these points, the penetration range is preferably 0.5 to 6.5, more preferably 0.5 to 2.0, and even more preferably 0.5 to 1.5.

The present invention also provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and the low molecular organic compound is an ethylene homopolymer having a branching ratio sum of no more than three.

As described above, by incorporating an ethylene homopolymer having a branching ratio sum of no more than three into the thermistor element as a low molecular organic compound, a thermistor element which can be loaded into a PTC thermistor having an operating temperature of between 80 and 100° C. can be constructed easily and reliably. Moreover, this type of PTC thermistor (to be referred to as "PTC thermistor (V)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (V) is capable of achieving excellent reliability.

The present inventors discovered that the thermal shock test causes the low molecular organic compound contained in the thermistor element to alter, which causes the resistance value following the thermal shock test to rise. As a result of an investigation into low molecular organic compounds contained in the thermistor element of P-PTC thermistors having a comparatively low operating temperature (no more than 100° C., and preferably between 80 and 100° C.), such as overcurrent protection elements for lithium ion secondary batteries and the like, the present inventors discovered that by using an ethylene homopolymer which satisfies the aforementioned branching ratio sum condition as the low molecular organic compound, increases in the resistance value following the thermal shock test due to such alteration of the low molecular organic compound can be reduced sufficiently.

In this specification, an "ethylene homopolymer having a branching ratio sum of no more than three" denotes a polymer having as the main component of its backbone a repeated unit based on ethylene, such as that expressed in the following Formula (1), in which the number of side chains per molecule branching from the main chain is between zero and three. Examples of this side chain structure include a structure having a side chain in which a hydrogen bonded to a carbon of the methylene group in the backbone is substituted by an alkyl group (for example, the structure to which a methyl group is bonded, as expressed by the following Formula (2)), a structure in which a characteristic group having an unsaturated bond (π bond) between two carbon atoms is inserted between the two methylene groups of the backbone (for example, the structure to which a vinylidene group is bonded, as expressed by the following Formula (3)), and a structure in which a carbonyl group is inserted between the two methylene groups of the backbone (for example, the structure expressed by the following Formula (4)). In the case of a polymer comprising only a repeated unit based on ethylene, for example, then an ethylene homopolymer with a branching ratio sum of zero is obtained.

[Formula 1]

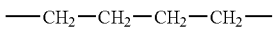

(1)

[Formula 2]

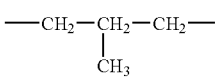

(2)

[Formula 3]

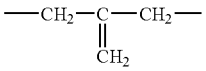

(3)

[Formula 4]

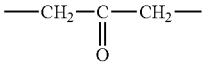

(4)

In this specification, the "branching ratio sum" is a value determined as follows. That is, the low molecular organic compound is analyzed using NMR (nuclear magnetic resonance) spectroscopy ($^{13}C$ measurement (standard) $^{1}H$ complete decoupling measurement, number of integrations: 50,000), and the branching sum ratio is calculated from this analysis. First, from the obtained NMR spectrum of the low molecular organic compound, the peak area of the chemical shift (ppm) attributed to the carbon atom at the branch end of the low molecular organic compound is divided by the overall peak area of all the carbon atoms in the low molecular organic compound, and indicated as a percentage (to be referred to as the "branching ratio" below). The sum of the branching ratio in each chemical shift (ppm) is then set as the "branching ratio sum" of the low molecular organic compound.

In the PTC thermistor (V) of the present invention, if the branching ratio sum of the ethylene homopolymer exceeds three, the resistance value following the thermal shock test exceeds 0.03Ω. In consideration of this point, the branching ratio sum of the ethylene homopolymer is preferably no more than two, more preferably no more than one, and even more preferably zero.

The present invention also provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, and a melting point T1 [° C.] of the high molecular matrix and a melting point T2 [° C.] of the low molecular organic compound satisfy the condition denoted below as (A).

$$7^\circ\ \mathrm{C.} \leqq (T1-T2) \leqq 40.5^\circ\ \mathrm{C.} \qquad \text{(A)}$$

As described above, by selecting a combination of a high molecular matrix and a low molecular organic compound in which T1-T2 is within a range of 7 to 40.5° C. to construct the thermistor element, a thermistor element which can be loaded into a PTC thermistor having an operating temperature between 80 and 100° C. can be constructed easily and reliably. Moreover, this type of PTC thermistor (to be referred to as "PTC thermistor (VI)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (VI) is capable of achieving excellent reliability.

Further, by selecting a combination of a high molecular matrix and a low molecular organic compound in which T1-T2 is within a range of 7 to 40.5° C. to construct the thermistor element, an extremely favorable PTC thermistor with an almost ideal resistance-temperature characteristic can be obtained. More specifically, on the resistance-temperature characteristic curve of a PTC thermistor loaded with a thermistor element which satisfies the T1-T2 condition, the resistance value rises rapidly and smoothly from the low temperature side to the desired resistance value only in a comparatively narrow temperature region between 80 and 100° C. (the operating temperature region), and in temperature regions other than the operating temperature region, the resistance value exhibits little variation and remains substantially constant. Particularly in the temperature region below the operating temperature region, the resistance value is held at a low value of 0.03Ω or less (see FIGS. 7 through 12, to be described below).

In the PTC thermistor (VI) of the present invention, if T1-T2 falls below 7° C., the resistance value following the thermal shock test exceeds 0.03Ω. Moreover, in this case it becomes impossible to obtain a PTC thermistor with a favorable resistance-temperature characteristic. As a result, for example, variation in the resistance value in the temperature region below the operating temperature region increases beyond 0.03Ω, the resistance value does not increase rapidly and smoothly from the low temperature side to the desired resistance value in the operating temperature region, and the resistance value also increases and decreases greatly in the higher temperature region than the operating temperature region.

Meanwhile, if T1-T2 exceeds 40.5° C., the resistance value following the thermal shock test exceeds 0.03Ω. Moreover, in this case it becomes impossible to obtain a PTC thermistor with a favorable resistance-temperature characteristic. As a result, for example, variation in the resistance value in the temperature region below the operating temperature region increases beyond 0.03Ω, the resistance value does not increase rapidly and smoothly from the low temperature side to the desired resistance value in the operating temperature region, and the resistance value also increases and decreases greatly in the higher temperature region than the operating temperature region. In consideration of these points, the preferable range of T1-T2 is 13 to 32° C.

The present invention also provides a PTC thermistor comprising at least a pair of electrodes disposed so as to face each other, and a thermistor element disposed between the pair of electrodes and having a positive resistance-temperature characteristic. Here, the thermistor element is a molded body constituted by a high molecular matrix, a low molecular organic compound, and conductive particles having electric conductivity, the molecular weight of the high molecular matrix is between 10,000 and 400,000, the molecular weight of the low molecular organic compound is between 100 and 3,000, the conductive particles are filamentary particles constituted by nickel, and these particles have a specific surface area between 1.5 and 2.5 $m^2/g$.

As described above, the thermistor element contains filamentary particles constituted by nickel having a specific surface area within a range of 1.5 to 2.5 $m^2/g$, and hence a thermistor element which can be loaded into a PTC thermistor having an operating temperature of between 80 and 100° C. can be constructed easily and reliably. Moreover, this type of PTC thermistor (to be referred to as "PTC thermistor (VII)" hereinafter), comprising a thermistor element which satisfies the conditions described above, has a resistance value obtained after a thermal shock test of no more than 0.03Ω. Accordingly, the resistance value obtained during the initial stage of usage can be maintained sufficiently even after repeated operations at an operating temperature of no more than 100° C. (preferably between 80 and 95° C.). Hence the PTC thermistor (VII) is capable of achieving excellent reliability.

In this specification, the term "filamentary particles constituted by nickel" indicates between approximately 10 and 100 primary particles of nickel (having an average particle diameter between 100 and 2,000 nm) linked in the form of a chain. Further, the "specific surface area" of the filamentary nickel particles in this specification indicates a specific surface area determined by a nitrogen gas absorption process based on a BET one-point method.

In the PTC thermistor (VII) of the present invention, if the specific surface area of the filamentary nickel particles falls below 1.5 $m^2/g$, the resistance value following the thermal shock test exceeds 0.03Ω. If the specific surface area of the filamentary nickel particles exceeds 2.5 $m^2/g$, the resistance value following the thermal shock test exceeds 0.03Ω. In consideration of these points, the specific surface area of the filamentary nickel particles is preferably between 1.5 and 2.0 $m^2/g$.

As a result of much committed research undertaken by the present inventors with the aim of achieving the aforementioned objects in consideration of the manufacturing conditions, it was discovered that the dispersibility of the conductive particles through the thermistor element greatly affects increases in the resistance value of the PTC thermistor (P-PTC thermistor) following the thermal shock test. More specifically, the present inventors discovered that by improving the dispersion condition (degree of dispersion) of the conductive particles through the thermistor element, the stability of the electrical characteristic when the thermistor element is subject to thermal expansion or thermal contraction can be improved, and subsequent increases in the resistance value can be suppressed.

The present inventors also discovered that in the method of manufacturing a thermistor element employed in conventional PTC thermistor manufacturing technology (whereby a mixture of polymeric material and conductive particles is kneaded in a heated state), the conductive particles are not dispersed sufficiently through the obtained thermistor element. Another problem arising in this conventional method is that when an attempt is made to improve the dispersibility of the conductive particles merely by optimizing the kneading conditions, for example increasing the kneading time or raising the rotation speed of the mill used during kneading, dispersion of the conductive particles into the polymeric material is advanced by share. As a result, share heat is generated, causing the temperature of the kneaded substance to rise such that an oxidation reaction in the polymeric material and/or the conductive particles advances more easily.

For example, the temperature of the kneaded substance may easily exceed 200° C. as a result of share heat. As the oxidation reaction of the polymeric material and/or the conductive particles progresses, the resistance value during the initial stage of the operation of the PTC thermistor at room temperature increases to the extent that the PTC thermistor becomes unusable.

The present inventors discovered that by introducing a preliminary dispersion step, to be described below, the aforementioned objects become achievable. Thus the inventors arrived at the present invention.

The present invention provides a manufacturing method for a PTC thermistor comprising at least a pair of electrodes disposed so as to face each other and a thermistor element disposed between the pair of electrodes and having a positive resistance-temperature characteristic, the thermistor element being a molded body constituted by a polymeric material and conductive particles having electric conductivity. This method comprises at least: a preliminary dispersion step for preparing a liquid mixture containing the polymeric material and conductive particles by mixing together the polymeric material, the conductive particles, and a liquid capable of dispersing or melting the polymeric material and dispersing the conductive particles; a liquid removal step for removing the liquid from the liquid mixture; and a heat-kneading step for kneading, in a heated state, the mixture of polymeric material and conductive particles obtained through the liquid removal step.

According to the manufacturing method of the present invention, a liquid mixture in which the polymeric material is dispersed or melted and the conductive particles are evenly dispersed is prepared in the preliminary dispersion step prior to the step of heat-kneading the conductive particles and polymeric material. Hence the dispersibility of the conductive particles through the obtained thermistor element can be improved easily and sufficiently. It is believed that the reason why the dispersibility of the conductive particles through the thermistor element improves is that the liquid used in the preliminary dispersion step reduces the viscosity of the polymeric material such that the polymeric material becomes looser. As a result, the wettability of the polymeric material in relation to the conductive particles improves, and the polymeric material becomes looser.

Further, the polymeric material and conductive particles can be mixed in advance in the preliminary dispersion step, and hence in the subsequent heat-kneading step, the dispersibility of the conductive particles through the thermistor element can be ensured sufficiently even when the kneading conditions are set such that share heat is not generated. As a result, the aforementioned oxidation reaction in the polymeric material and/or the conductive particles can be satisfactorily prevented from advancing.

Hence according to the manufacturing method of the present invention, a PTC thermistor having excellent reliability, which has a resistance value obtained following a thermal shock test of no more than 0.03Ω, and which is capable of maintaining a resistance value obtained during an initial stage of usage sufficiently even when operated repeatedly at an operating temperature of no more than 100° C., can be constructed easily and securely.

In the manufacturing method of the present invention, to further improve the dispersibility of the conductive particles through the thermistor element, the "liquid capable of dispersing or melting the polymeric material and dispersing the conductive particles" is preferably a solvent that is capable of melting all of the types of polymeric material contained in the thermistor element.

Also in the manufacturing method of the present invention, to further improve the dispersibility of the conductive particles through the thermistor element, the liquid mixture is preferably prepared while being heated in the preliminary dispersion step, and more preferably, the temperature of the liquid mixture from the beginning to the end of preparation is regulated to between 100 and 130° C. In so doing, the solubility and degree of dispersion of the polymeric material into the liquid can be improved.

Further, in the manufacturing method of the present invention, to further facilitate and ensure the construction of a PTC thermistor having excellent reliability as described above, the polymeric material and conductive particles are preferably selected for use to form the thermistor element assemblies to be loaded into the aforementioned PTC thermistors (I) through (VII) of the present invention.

More specifically, in the manufacturing method of the present invention, at least a high molecular matrix having a molecular weight of between 10,000 and 400,000 is preferably used as the polymeric material. When a high molecular matrix is to be used, a low molecular organic compound having a molecular weight of between 100 and 3,000 is also preferably used as the polymeric material. Note, however, that a low molecular organic compound having a molecular weight of between 100 and 3,000 may be used alone as the polymeric material.

Further, when a high molecular matrix is used in the manufacturing method of the present invention, the high molecular matric is preferably an olefin-type high molecular compound having a melting start temperature between 85 and 95° C. Further, when a high molecular matrix is used, the density of the high molecular matrix is preferably between 920 and 928 kg/m$^3$. Further, when a high molecular matrix is used, the coefficient of linear expansion of the high molecular matrix is preferably between $1.00\times10^{-4}$ and $5.43\times10^{-4}$.

Further, when a high molecular matrix is used in the manufacturing method of the present invention, the high molecular matrix is preferably polyethylene. In this case, the polyethylene is preferably straight chain low density polyethylene obtained through a polymerization reaction using a metallocene catalyst.

When a low molecular organic compound is used in the manufacturing method of the present invention, the penetration of the low molecular organic compound at 25° C. is preferably between 0.5 and 6.5. Further, when a low molecular organic compound is used, the low molecular organic compound is preferably an ethylene homopolymer having a branching ratio sum of no more than three.

When a high molecular matrix and a low molecular organic compound are used together in the manufacturing method of the present invention, a melting point T1 [° C.] of the high molecular matrix and a melting point T2 [° C.] of the low molecular organic compound preferably satisfy the condition denoted below as (A).

$$7^\circ\ \text{C.} \leqq (T1-T2) \leqq 40.5^\circ\ \text{C.} \qquad \text{(A)}$$

Also in the manufacturing method of the present invention, filamentary particles constituted by nickel and having a specific surface area between 1.5 and 2.5 m$^2$/g are preferably used as the conductive particles.

BEST MODES FOR CARRYING OUT THE INVENTION

Preferred embodiments of a PTC thermistor of the present invention will be described in detail below with reference to the drawings. Note that in the following description, identical or corresponding parts have been allocated identical reference symbols, and duplicate description thereof has been omitted.

First Embodiment

Figure 1:
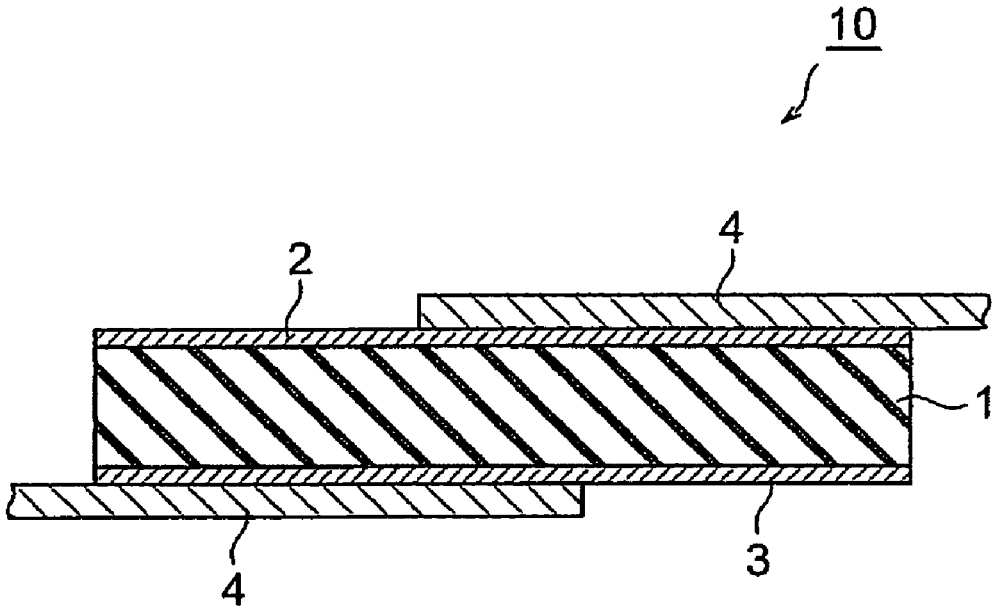
FIG. 1 is a schematic sectional view showing the basic constitution of a first embodiment of a PTC thermistor according to the present invention.

FIG. 1 is a schematic sectional view showing the basic constitution of a first embodiment of the PTC thermistor according to the present invention. A PTC thermistor 10 shown in FIG. 1 shows the basic constitution of a preferred embodiment of the PTC thermistor (I) described above.

The PTC thermistor 10 shown in FIG. 1 is constituted mainly by a pair of electrodes 2 and 3 disposed so as to face each other, a thermistor element 1 disposed between the electrode 2 and electrode 3 and having a positive resistance-temperature characteristic, a lead 4 connected electrically to the electrode 2, and a lead 5 connected electrically to the electrode 3.

The electrode 2 and electrode 3 take the form of flat plates, for example, and there are no particular limitations thereon as long as they possess electric conductivity in order to function as electrodes for a PTC thermistor. There are also no particular limitations on the lead 4 and lead 5 as long as they possess electric conductivity to be able to discharge or inject a charge out of or into the electrode 2 and electrode 3 respectively.

A thermistor element 1 of the PTC thermistor 10 shown in FIG. 1 is a molded body constituted by a high molecular matrix, a low molecular organic compound, and conductive particles possessing electric conductivity. To be able to obtain a resistance value in the PTC thermistor 10 of no more than 0.03Ω following a thermal shock test, and to maintain the resistance value obtained during an initial stage of usage sufficiently, even after repeated operations at an operating temperature of no more than 100° C., the thermistor element 1 has the following constitution.

As described above, the high molecular matrix contained in the thermistor element 1 is an olefin-type high molecular compound having a molecular weight (number average molecular weight) between 10,000 and 400,000, and preferably between 100,000 and 200,000. This high molecular matrix has a melting start temperature between 85 and 95° C.

In the PTC thermistor 10 loaded with the thermistor element 1 that is constituted by the high molecular matrix, low molecular organic compound, and conductive particles, one reason for increases in the resistance value following a thermal shock test is that the high molecular matrix in the thermistor element is melted by the thermal processing performed during the thermal shock test. Hence, considering the operating temperature, the melting point of the high molecular matrix is preferably set to between 90 and 138° C., and more preferably between 100 and 125° C.

In the case of the PTC thermistor 10 of the first embodiment, the density of the high molecular matrix is preferably between 915 and 935 kg/m$^3$, and more preferably between 920 and 928 kg/m$^3$.

Further, in the PTC thermistor 10 loaded with the thermistor element 1, another possible reason for increases in the resistance value following a thermal shock test is that internal stress which is generated within the high molecular matrix causes deformation of a minute partial region of the thermistor element 1. This deformation in a minute partial region of the thermistor element may cause the resistance value to rise. Therefore, it is preferable that a crystalline polymer having a linear expansion coefficient that is little different to that of the conductive particles be used as the high molecular matrix.

Hence in the case of the PTC thermistor 10 of the first embodiment, the coefficient of linear expansion of the high molecular matrix is preferably between $1.00\times10^{-4}$ and $5.43\times10^{-4}$.

As described above, in order to obtain a favorable resistance-temperature characteristic, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor 10 can be obtained easily with little hysteresis on the resistance-temperature characteristic curve.

One, two, or more types of an olefin-type high molecular compound which satisfies at least the molecular weight and melting start temperature conditions described above (or more preferably, a high molecular compound which also satisfies at least one of the other conditions described above relating to density, linear expansion coefficient, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

By incorporating this type of straight chain low-density polyethylene into the thermistor element 1, a thermistor with a comparatively low operating temperature, which is suitable for applications such as an overcurrent protection element for a lithium ion secondary battery, can be obtained easily.

Here, "straight chain low density polyethylene" denotes intermediate/low pressure polyethylene manufactured by means of a polymerization reaction using a metallocene catalyst and having a comparatively narrow molecular weight distribution. The term "metallocene catalyst" denotes a bis(cyclopentadienyl) metal complex catalyst, which is a compound expressed as shown below in general formula (5).

[Formula 5]

$$M(C_5H_5)_2XY \quad (5)$$

In Formula (5), M denotes a metal centered around four coordinates or the metal ion thereof, X and Y denote halogen or a halide ion, and may be identical or different. Ti, Zr, Hf, V, Nb, or Ta are preferable as M, and Zr is more preferable. Cl is preferable as X and Y. As the compound expressed in general formula (5), one type may be used individually, or two or more types may be used in an arbitrary combination.

The straight chain low density polyethylene may be manufactured by a well-known low density polyethylene manufacturing technique using the metallocene catalyst in formula (5). Ethylene may be used as the monomer in the raw materials, and butene-1, hexene-1, and octene-1 may be used as comonomers.

The compounds expressed in the following general formulas (6) and (7) may be used as well as the metallocene catalyst.

[Formula 6]

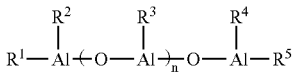

(6)

[Formula 7]

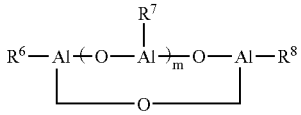

(7)

where $R^1$, $R^2$, $R^3$, $R^4$, and $R^5$ in Formula (6) denote alkyl groups with carbon numbers of 1 to 3 respectively, and may be identical or different, and n denotes an integer between 2 and 20. Methyl groups are preferable as $R^1$, $R^2$, $R^3$, $R^4$, and $R^5$. $R^6$, $R^7$, and $R^8$ in Formula (7) denote alkyl groups with carbon numbers of 1 to 3 respectively, and may be identical or different, and m denotes an integer between 2 and 20. Methyl groups are preferable as $R^6$, $R^7$, and $R^8$.

Taking the volume of the thermistor element 1 as a reference, the high molecular matrix content of the thermistor element 1 is preferably between 35 and 70 volume percent, and more preferably between 40 and 65 volume percent.

The low molecular organic compound is added to reduce the hysteresis appearing on the resistance-temperature characteristic curve of the PTC thermistor 10 as a result of the thermal processing that is performed in the thermal shock test. As described above, this low molecular organic compound has a molecular weight (number average molecular weight) between 100 and 3,000, and preferably between 500 and 1,000.

To achieve the aforementioned effects of the present invention even more reliably, the melting point of the low molecular organic compound is preferably between 90 and 115° C. As noted above, the penetration of the low molecular organic compound at 25° C. is preferably between 2 and 7, and more preferably between 0.5 and 6.5.

One, two, or more types of a compound of paraffin wax (polyethylene wax, micro-crystalline wax) which satisfies the molecular weight condition described above (or more preferably, a compound which also satisfies the penetration condition described above), for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element 1 as a reference, the low molecular organic compound content of the thermistor element 1 is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area between 1.5 and 2.5 $m^2/g$ are more preferable.

Taking the volume of the thermistor element 1 as a reference, the conductive particle content of the thermistor element 1 is preferably between 20 and 60 volume percent, and more preferably between 25 and 50 volume percent.

After forming the thermistor element 1 by selecting the high molecular matrix, low molecular organic compound, and conductive particles in order to satisfy the conditions described above and adjusting the content of each, the PTC thermistor may be manufactured using a well-known PTC thermistor manufacturing technique.

Second Embodiment

Next, a second embodiment {a preferred embodiment of the aforementioned PTC thermistor (II)} of the PTC thermistor according to the present invention will now be described.

The PTC thermistor (not shown) of the second embodiment is constituted identically to the PTC thermistor of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000. The density of the high molecular matrix is between 920 and 928 $kg/m^3$.

To obtain the aforementioned effects of the present invention even more reliably, the high molecular matrix has a melting start temperature between 80 and 115° C., and preferably between 85 and 95° C. As described above, in consideration of the operating temperature, the melting point of the high molecular matrix is preferably set between 90 and 138° C., and more preferably between 100 and 125° C.

In order to use a crystalline polymer having a linear expansion coefficient that is little different to that of the conductive particles as the high molecular matrix, the coefficient of linear expansion of the high molecular matrix is preferably between $1.00\times10^{-4}$ and $5.43\times10^{-4}$ in the case of this PTC thermistor.

As described above, in order to obtain a favorable resistance-temperature characteristic, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor can be obtained easily with little hysteresis on the resistance-temperature characteristic curve.

One, two, or more types of a compound which satisfies at least the molecular weight and density conditions described above (or more preferably, a compound which also satisfies at least one of the other conditions described above relating to the melting start temperature, coefficient of linear expansion, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 45 and 65 volume percent.

The low molecular organic compound is added to reduce the hysteresis appearing on the resistance-temperature characteristic curve of the PTC thermistor as a result of the thermal processing that is performed in the thermal shock test. As described above, this low molecular organic compound has a molecular weight (number average molecular weight) between 100 and 3,000, and preferably between 500 and 1,000.

To achieve the aforementioned effects of the present invention even more reliably, the melting point of the low molecular organic compound is preferably between 90 and 115° C. As noted above, the penetration of the low molecular organic compound at 25° C. is preferably between 2 and 7, and more preferably between 0.5 and 6.5.

One, two, or more types of a compound of paraffin wax (polyethylene wax, micro-crystalline wax) which satisfies the molecular weight condition described above (or more preferably, a compound which also satisfies the penetration condition described above), for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element as a reference, the low molecular organic compound content of the thermistor element is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area between 1.5 and 2.5 $m^2/g$ are more preferable.

Taking the volume of the thermistor element 1 as a reference, the conductive particle content of the thermistor element 1 is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Third Embodiment

Next, a third embodiment {a preferred embodiment of the aforementioned PTC thermistor (III)} of the PTC thermistor according to the present invention will now be described.

The PTC thermistor (not shown) of the third embodiment is constituted identically to the PTC thermistor 10 of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000. The linear expansion coefficient of the high molecular matrix is between $1.00\times10^{-4}$ and $5.43\times10^{-4}$.

To obtain the aforementioned effects of the present invention even more reliably, the density of the high molecular matrix is preferably between 915 and 935° C., and more preferably between 920 and 928 $kg/m^3$. From the same consideration, the melting start temperature of the high molecular matrix is preferably between 80 and 115° C., and more preferably between 85 and 95° C. As described above, in consideration of the operating temperature, the melting point of the high molecular matrix is preferably set to between 90 and 138° C., and more preferably between 100 and 125° C.

As described above, in order to obtain a favorable resistance-temperature characteristic, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor can be obtained easily with little hysteresis on the resistance-temperature characteristic curve.

One, two, or more types of a compound which satisfies at least the molecular weight and linear expansion coefficient conditions described above (or more preferably, a compound which also satisfies at least one of the other conditions described above relating to the melting start temperature, density, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 40 and 65 volume percent.

The low molecular organic compound is added to reduce the hysteresis appearing on the resistance-temperature characteristic curve of the PTC thermistor as a result of the thermal processing that is performed in a thermal shock test. As described above, this low molecular organic compound has a molecular weight (number average molecular weight) between 100 and 3,000, and preferably between 500 and 1,000.

To achieve the aforementioned effects of the present invention even more reliably, the melting point of the low molecular organic compound is preferably between 90 and 115° C. As noted above, the penetration of the low molecular organic compound at 25° C. is preferably between 2 and 7, and more preferably between 0.5 and 6.5.

One, two, or more types of a compound of paraffin wax (polyethylene wax, micro-crystalline wax) which satisfies the molecular weight condition described above (or more preferably, a compound which also satisfies the penetration condition described above), for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element as a reference, the low molecular organic compound content of the thermistor element is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area between 1.5 and 2.5 $m^2/g$ are more preferable.

Taking the volume of the thermistor element 1 as a reference, the conductive particle content of the thermistor element 1 is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Fourth Embodiment

Next, a fourth embodiment {a preferred embodiment of the aforementioned PTC thermistor (IV)} of the PTC thermistor according to the present invention will now be described.

The PTC thermistor (not shown) of the fourth embodiment is constituted identically to the PTC thermistor 10 of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000.

To obtain the aforementioned effects of the present invention even more reliably, the melting start temperature of the high molecular matrix is preferably between 80 and 115° C., and more preferably between 85 and 95° C. In consideration of the operating temperature as described above, the melting point of the high molecular matrix is preferably set to between 90 and 138° C., and more preferably between 100 and 125° C. Further, as described above, the density of the high molecular matrix is preferably between 915 and 935 $kg/m^3$, and more preferably between 920 and 928 $kg/m^3$.

In order to use a crystalline polymer having a linear expansion coefficient that is little different to that of the conductive particles as the high molecular matrix, the linear expansion coefficient of the high molecular matrix is preferably between $1.00\times10^{-4}$ and $5.43\times10^{-4}$ in the case of this PTC thermistor.

In order to obtain a favorable resistance-temperature characteristic as described above, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor can be obtained easily with little hysteresis on the resistance-temperature characteristic curve.

One, two, or more types of a compound which satisfies at least the molecular weight condition described above (or more preferably, a compound which also satisfies at least one of the other conditions described above relating to the melting start temperature, coefficient of linear expansion, density, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 40 and 65 volume percent.

The low molecular organic compound is added to reduce the hysteresis appearing on the resistance-temperature characteristic curve of the PTC thermistor as a result of the thermal processing that is performed in a thermal shock test. As described above, this low molecular organic compound has a molecular weight (number average molecular weight) between 100 and 3,000, and preferably between 500 and 1,000.

To achieve the aforementioned effects of the present invention more reliably, the penetration of the low molecular organic compound at 25° C. is between 0.5 and 6.5 in this PTC thermistor. To achieve the aforementioned effects of the present invention even more reliably, the melting point of the low molecular organic compound is preferably between 90 and 115° C.

One, two, or more types of a compound of paraffin wax (polyethylene wax, micro-crystalline wax) which satisfies the molecular weight and penetration conditions described above, for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element as a reference, the low molecular organic compound content of the thermistor element is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area between 1.5 and 2.5 $m^2/g$ are more preferable.

Taking the volume of the thermistor element 1 as a reference, the conductive particle content of the thermistor element 1 is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Fifth Embodiment

Next, a fifth embodiment {a preferred embodiment of the aforementioned PTC thermistor (V)} of the PTC thermistor according to the present invention will now be described.

The PTC thermistor (not shown) of the fifth embodiment is constituted identically to the PTC thermistor 10 of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000.

To obtain the aforementioned effects of the present invention even more reliably, the melting start temperature of the high molecular matrix is preferably between 80 and 115° C., and more preferably between 85 and 95° C. In consideration of the operating temperature as described above, the melting point of the high molecular matrix is preferably set to between 90 and 138° C., and more preferably between 100 and 125° C. Further, as described above, the density of the high molecular matrix is preferably between 915 and 935 $kg/m^3$, and more preferably between 920 and 928 $kg/m^3$.

In order to use a crystalline polymer having a linear expansion coefficient that is little different to that of the conductive particles as the high molecular matrix, the linear expansion coefficient of the high molecular matrix is preferably between $1.00\times10^{-4}$ and $5.43\times10^{-4}$ in the case of this PTC thermistor.

In order to obtain a favorable resistance-temperature characteristic as described above, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor can be obtained easily with little hysteresis on the resistance-temperature characteristic curve.

One, two, or more types of a compound which satisfies at least the molecular weight condition described above (or more preferably, a compound which also satisfies at least one of the other conditions described above relating to the melting start temperature, coefficient of linear expansion, density, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 40 and 65 volume percent.

The low molecular organic compound is added to reduce the hysteresis appearing on the resistance-temperature characteristic curve of the PTC thermistor as a result of the thermal processing that is performed in a thermal shock test. As described above, this low molecular organic compound has a molecular weight (number average molecular weight) between 100 and 3,000, and preferably between 500 and 1,000.

To achieve the aforementioned effects of the present invention more reliably, the low molecular organic compound is an ethylene homopolymer having a branching ratio sum of three or less. To achieve the aforementioned effects of the present invention even more reliably, the branching ratio sum of this ethylene homopolymer is preferably two or less, more preferably one or less, and even more preferably zero.

Also to achieve the aforementioned effects of the present invention more reliably, the penetration of the low molecular organic compound at 25° C. is preferably between 2 and 7, and more preferably between 0.5 and 6.5. To achieve the aforementioned effects of the present invention even more reliably, the melting point of the low molecular organic compound is preferably between 90 and 115° C.

Taking the volume of the thermistor element as a reference, the low molecular organic compound content of the thermistor element is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area of between 1.5 and 2.5 $m^2/g$ are more preferable.

Taking the volume of the thermistor element as a reference, the conductive particle content of the thermistor element is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Sixth Embodiment

Next, a sixth embodiment {a preferred embodiment of the aforementioned PTC thermistor (VI)} of the PTC thermistor according to the present invention will now be described.

The PTC thermistor (not shown) of the sixth embodiment is constituted identically to the PTC thermistor 10 of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000.

To obtain the aforementioned effects of the present invention even more reliably, the melting start temperature of the high molecular matrix is preferably between 80 and 115° C., and more preferably between 85 and 95° C. In consideration of the operating temperature as described above, the melting point of the high molecular matrix is preferably set to between 90 and 138° C., and more preferably between 100 and 125° C. Further, as described above, the density of the high molecular matrix is preferably between 915 and 935 $kg/m^3$, and more preferably between 920 and 928 $kg/m^3$.

In order to use a crystalline polymer having a linear expansion coefficient that is little different to that of the conductive particles as the high molecular matrix, the linear expansion coefficient of the high molecular matrix is preferably between $1.00\times10^{-4}$ and $5.43\times10^{-4}$ in the case of this PTC thermistor.

In order to achieve the effects of the present invention and obtain a favorable resistance-temperature characteristic as described above, the difference T1-T2 between the melting point T1 [° C.] of the high molecular matrix and the melting point T2 [° C.] of the low molecular organic compound is between 7 and 40.5° C. As a result, the PTC thermistor can be obtained easily with little hysteresis on the resistance-temperature characteristic curve.

One, two, or more types of a compound which satisfies at least the conditions relating to molecular weight and melting point difference with the low molecular organic compound described above (or more preferably, a compound which also satisfies at least one of the other conditions described above relating to the melting start temperature, coefficient of linear expansion, and density), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 40 and 65 volume percent.

The low molecular organic compound is added to reduce the hysteresis appearing on the resistance-temperature characteristic curve of the PTC thermistor as a result of the thermal processing that is performed in a thermal shock test. As described above, this low molecular organic compound has a molecular weight (number average molecular weight) between 100 and 3,000, and preferably between 500 and 1,000.

To achieve the aforementioned effects of the present invention more reliably, the melting point of the low molecular organic compound is preferably between 90 and 115° C. Further, as described above, the penetration of the low molecular organic compound at 25° C. is preferably between 2 and 7, and more preferably between 0.5 and 6.5.

One, two, or more types of a compound of paraffin wax (polyethylene wax, micro-crystalline wax) which satisfies the molecular weight condition described above (or more preferably, a compound which also satisfies the penetration condition described above), for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element as a reference, the low molecular organic compound content of the thermistor element is preferably between 2 and 30 volume percent, and more preferably between 2 and 25 volume percent.

There are no particular limitations on the conductive particles as long as they possess electric conductivity, but in order to obtain the aforementioned effects of the present invention even more reliably, particles constituted by at least one type of conductive substance selected from a group comprising conductive ceramic powder (for example, TiC, WC, and so on), carbon black, silver, tungsten, and nickel are preferable. Filamentary particles of nickel having a specific surface area between 1.5 and 2.5 $m^2/g$ are more preferable.

Taking the volume of the thermistor element as a reference, the conductive particle content of the thermistor element is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Seventh Embodiment

Next, a seventh embodiment {a preferred embodiment of the aforementioned PTC thermistor (VII)} of the PTC thermistor according to the present invention will now be described.

The PTC thermistor (not shown) of the seventh embodiment is constituted identically to the PTC thermistor 10 of the first embodiment described above, apart from comprising the thermistor element (not shown) to be described below.

The thermistor element of this PTC thermistor is a molded body comprising a high molecular matrix, a low molecular organic compound, and conductive particles possessing electric conductivity. To be able to obtain a resistance value in the PTC thermistor of no more than 0.03Ω following a thermal shock test, and to maintain the resistance value obtained during the initial stage of usage sufficiently, even after repeated operations at an operating temperature of no more than 100° C., the thermistor element has the following constitution.

As described above, the high molecular matrix contained in the thermistor element has a molecular weight (number average molecular weight) between 10,000 and 400,000, and preferably between 100,000 and 200,000.

To obtain the aforementioned effects of the present invention even more reliably, the melting start temperature of the high molecular matrix is preferably between 80 and 115° C., and more preferably between 85 and 95° C. In consideration of the operating temperature as described above, the melting point of the high molecular matrix is preferably set to between 90 and 138° C., and more preferably between 100 and 125° C. Further, as described above, the density of the high molecular matrix is preferably between 915 and 935 $kg/m^3$, and more preferably between 920 and 928 $kg/m^3$.

In order to use a crystalline polymer having a linear expansion coefficient that is little different to that of the conductive particles as the high molecular matrix, the linear expansion coefficient of the high molecular matrix is preferably between $1.00\times10^{-4}$ and $5.43\times10^{-4}$ in the case of this PTC thermistor.

In order to obtain a favorable resistance-temperature characteristic as described above, the difference T1-T2 between the melting point T1 [° C.] of the high molecular matrix and the melting point T2 [° C.] of the low molecular organic compound is preferably between 7 and 48° C., and more preferably between 7 and 40.5° C. As a result, the PTC thermistor can be obtained easily with little hysteresis on the resistance-temperature characteristic curve.

One, two, or more types of a compound which satisfies at least the molecular weight condition described above (or more preferably, a compound which also satisfies at least one of the other conditions described above relating to the melting start temperature, coefficient of linear expansion, density, and melting point difference with the low molecular organic compound), from among the polymeric materials described in Japanese Unexamined Patent Application Publication H11-168006, for example, may be combined as desired and used as the high molecular matrix. Further, polyethylene is preferable as the high molecular matrix, low density polyethylene is more preferable, and straight chain low density polyethylene manufactured by means of a polymerization reaction using a metallocene catalyst is even more preferable.

The "straight chain low density polyethylene" in this case again denotes intermediate/low pressure polyethylene manufactured by means of a polymerization reaction using a metallocene catalyst and having a comparatively narrow molecular weight distribution, as described above. The term "metallocene catalyst" again denotes a bis(cyclopentadienyl) metal complex catalyst, which is a compound expressed as above in general formula (5).

In this PTC thermistor, taking the volume of the thermistor element as a reference, the high molecular matrix content of the thermistor element is preferably between 35 and 70 volume percent, and more preferably between 40 and 65 volume percent.

The low molecular organic compound is added to reduce the hysteresis appearing on the resistance-temperature characteristic curve of the PTC thermistor as a result of the thermal processing that is performed in a thermal shock test. As described above, this low molecular organic compound has a molecular weight (number average molecular weight) between 100 and 3,000, and preferably between 500 and 1,000.

To achieve the aforementioned effects of the present invention more reliably, the melting point of the low molecular organic compound is preferably between 90 and 115° C. Further, as described above, the penetration of the low molecular organic compound at 25° C. is preferably between 2 and 7, and more preferably between 0.5 and 6.5.

One, two, or more types of a compound of paraffin wax (polyethylene wax, micro-crystalline wax) which satisfies the molecular weight condition described above (or more preferably, a compound which also satisfies the penetration condition described above), for example, may be combined as desired and used as the low molecular organic compound. To achieve the aforementioned effects of the present invention even more reliably, the low molecular organic compound is preferably an ethylene homopolymer having a branching ratio sum of six or less, and more preferably an ethylene homopolymer having a branching ratio sum of three or less.

Taking the volume of the thermistor element as a reference, the low molecular organic compound content of the thermistor element is preferably between 2 and 30 volume percent, and more preferably between 2 and 25 volume percent.

To achieve the aforementioned effects of the present invention in this PTC thermistor, the conductive particles are filamentary particles constituted by nickel having a specific surface area of between 1.5 and 2.5 $m^2/g$.

Taking the volume of the thermistor element as a reference, the filamentary nickel particle content of the thermistor element is preferably between 20 and 60 volume percent, and more preferably between 25 and 50 volume percent.

This PTC thermistor may also be manufactured using a well-known PTC thermistor manufacturing technique after forming the thermistor element by selecting the high molecular matrix, low molecular organic compound, and conductive particles in order to satisfy the conditions described above and adjusting the content of each.

Next, preferred embodiments of a manufacturing method for the PTC thermistor according to the present invention will be described.

Figure 2:
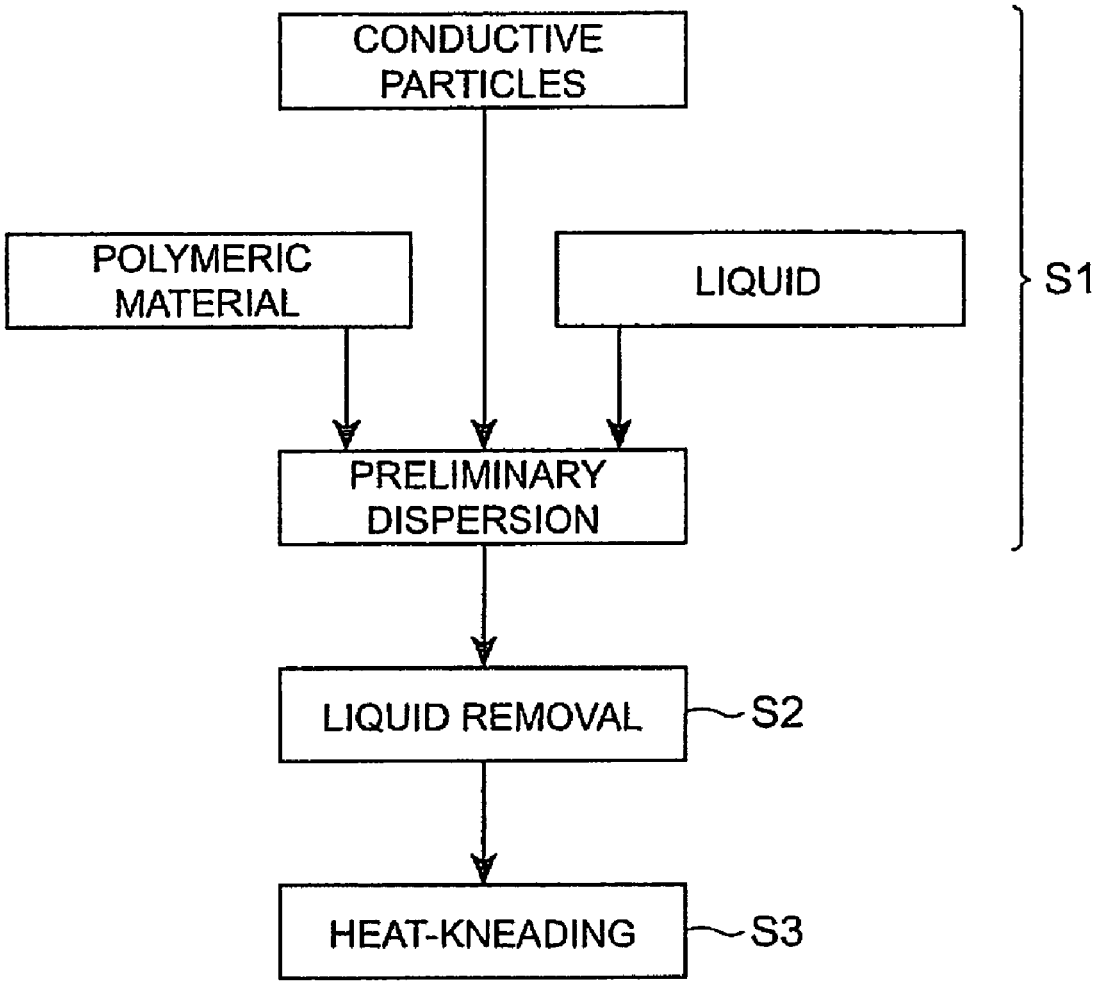
FIG. 2 is a process diagram showing a preferred embodiment of a manufacturing method for the PTC thermistor of the present invention.

FIG. 2 is a process diagram showing a preferred embodiment of the manufacturing method for the PTC thermistor according to the present invention. As shown in FIG. 2, in the manufacturing method of this embodiment, first the polymeric materials, the conductive particles, and a liquid that is capable of dispersing or melting the polymeric materials and dispersing the conductive particles are introduced into a predetermined container simultaneously in a preliminary dispersion step S1. These three components are then mixed to prepare a liquid mixture containing the polymeric materials and conductive particles. The conductive particles are dispersed sufficiently evenly throughout the obtained mixed solution. The polymeric materials are also dispersed or melted sufficiently evenly throughout the obtained mixed solution.

In the preliminary dispersion step S1, the liquid mixture may be prepared at room temperature, but to improve the dispersibility of the conductive particles through the obtained thermistor element, the liquid mixture is preferably prepared while being heated. The temperature of the liquid mixture from the beginning to the end of its preparation is preferably regulated to between 100 and 130° C. In so doing, the degree of melting or dispersion of the polymeric materials throughout the liquid can be improved.

A liquid (solvent) which is capable of melting the polymeric materials and dispersing the conductive particles is preferably used as the liquid in the preliminary dispersion step S1. Favorable examples of such a liquid include toluene, benzene, and xylene.

Also in the preliminary dispersion step S1, to construct a PTC thermistor having excellent reliability more easily and reliably, the polymeric materials (high molecular matrix and low molecular organic compound) and the conductive particles described above in the first through seventh embodiments are preferably selected and used such that the thermistor element assemblies loaded into the PTC thermistors of the first through seventh embodiments can be formed as described above.

Following the preliminary dispersion step S1, the liquid of the liquid mixture prepared in the preliminary dispersion step S1 is removed in a liquid removal step S2. More specifically, drying means such as a vacuum dryer are used to heat-dry the liquid mixture such that the liquid is removed.

Following the liquid removal step S2, the mixture of polymeric materials and conductive particles obtained in the liquid removal step S2 is kneaded under heat in a heat-kneading step S3. More specifically, agitating means such as an agitator are used to heat-knead the mixture of polymeric materials and conductive particles by agitating the mixture at a temperature of between 120 and 200° C.

The kneaded substance comprising the polymeric materials and conductive particles, which is obtained as a result of this heat-kneading, is then molded into sheet-form to produce the thermistor element. Next, the thermistor element is disposed between a pair of electrodes constituted by a metal foil such as copper foil, for example, so as to be firmly attached thereto, whereupon a hot-press is used to fix the thermistor element to the two electrodes. This constitution is then cut to a desired size and shape, whereupon the leads are electrically connected to the electrode parts to complete the PTC thermistor.

Figure 3:
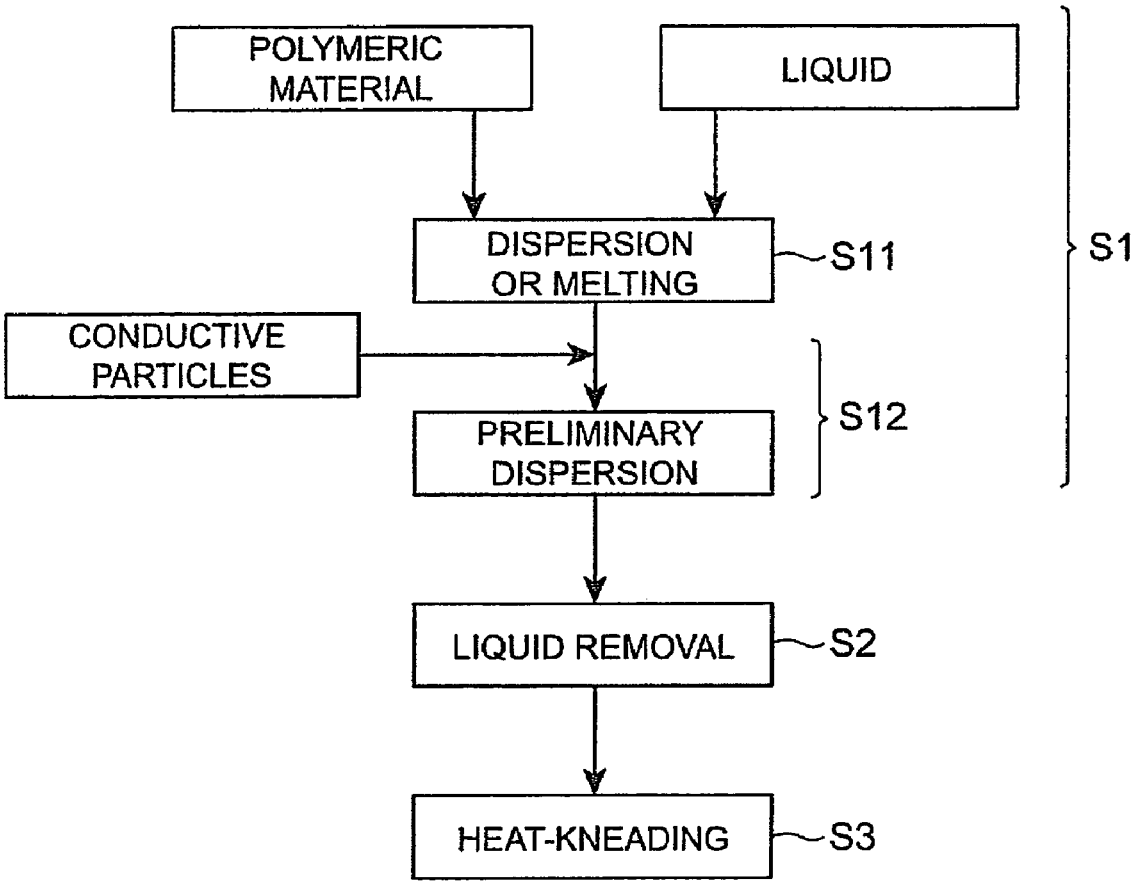
FIG. 3 is a process diagram showing another preferred embodiment of the manufacturing method for the PTC thermistor of the present invention.

FIG. 3 is a process diagram showing another preferred embodiment of the manufacturing method for the PTC thermistor according to the present invention. The manufacturing method shown in FIG. 3 is identical to the manufacturing method shown in FIG. 2 and described above, apart from the procedures of the preliminary dispersion step S1 to be described below.

The preliminary dispersion step S1 of the manufacturing method shown in FIG. 3 comprises a step S11 in which polymeric materials 1 and a liquid are mixed, and a step S12 following step S11 in which conductive particles 2 are added to the liquid mixture prepared in step S11, and the resulting mixture is agitated and mixed. By adding step S11 to the preliminary dispersion step S1, the polymeric materials can be sufficiently dispersed or melted into the liquid in advance, and hence the conductive particles introduced in step S12 can be dispersed easily.

Figure 4:
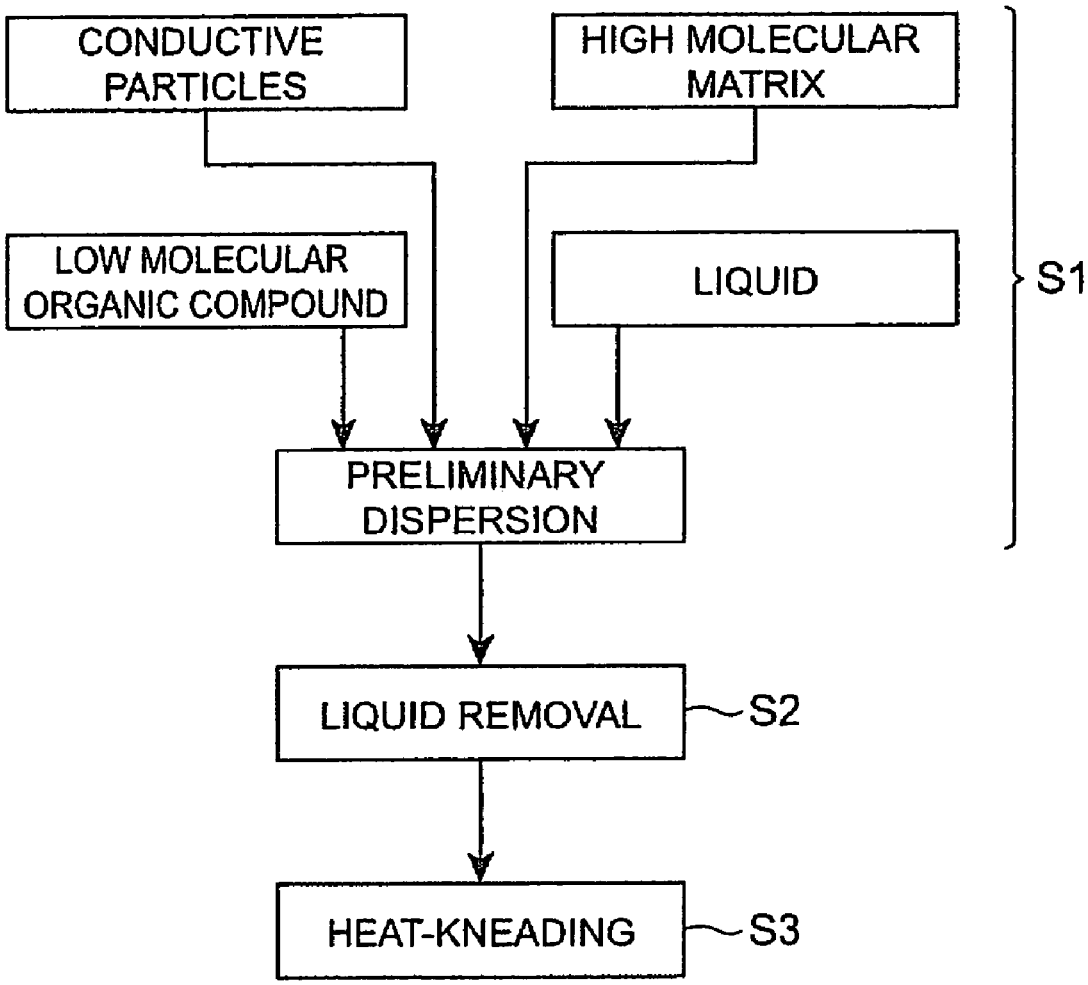
FIG. 4 is a process diagram showing a further preferred embodiment of the manufacturing method for the PTC thermistor of the present invention.

Preferred embodiments of the manufacturing method of the present invention were described above, but the manufacturing method of the present invention is not limited to these embodiments. For example, the "high molecular matrix" and "low molecular organic compound" described above may be used together as the polymeric materials. In this case, the PTC thermistor may be constructed according to a method comprising the procedures shown in FIG. 4, for example. FIG. 4 is a process diagram showing a further preferred embodiment of the manufacturing method of the present invention. The manufacturing method shown in FIG. 4 is identical to the manufacturing method shown in FIG. 2 and described above, apart from the procedures of the preliminary dispersion step S1 to be described below.

In the preliminary dispersion step S1 of the manufacturing method shown in FIG. 4, the liquid mixture is prepared by introducing the high molecular matrix, low molecular organic compound, conductive particles, and liquid into a predetermined container simultaneously. In this case, the low molecular organic compound, which has a comparatively low melting point, does not have to be used in the preparation of the liquid mixture in the preliminary dispersion step S1, and may be added to the mixture of the high molecular matrix and conductive particles obtained in the liquid removal step S2 during the subsequent heat-kneading step S3.

EXAMPLES

Next, the PTC thermistor of the present invention will be described in further detail using examples and comparative examples. Note, however, that the present invention is not limited to these examples.

Example 1

Straight chain low density polyethylene (melting start temperature: 85° C., melting point: 122° C., specific gravity: 0.93, number average molecular weight: 36,000) manufactured using a metallocene catalyst and serving as the high molecular matrix, polyethylene wax (melting point: 90° C., number average molecular weight: 600) serving as the low molecular organic compound, and filamentary nickel particles (average particle diameter: 0.7 μm) serving as the conductive particles were introduced into a mill in quantities of 45 volume percent, 25 volume percent, and 30 volume percent respectively, and then heat-kneaded for thirty minutes at a temperature of 150° C.

Following kneading, the two sides of the kneaded substance were sandwiched by 25 μm nickel foil (electrodes), whereupon a hot-press was used to fix the kneaded substance and nickel foil together at 150° C., thereby producing a molded object having an overall thickness of 0.3 mm and a diameter of 100 mm. The two sides of the molded object were then irradiated with electron beams under a condition of 200 kGy to promote a cross-linking reaction between the polymeric materials in the interior of the molded object and thereby stabilize the molded object thermally and mechanically, whereupon the molded object was stamped into an angled shape having length and breadth dimensions of 9 mm×3 mm. As a result, a PTC thermistor was obtained with a constitution in which the kneaded and molded sheet (thermistor element) comprising the low molecular organic compound, high molecular matrix, and conductive particles is disposed between and fixed to the two electrodes formed from nickel foil.

Example 2

A PTC thermistor was manufactured by the same procedures and under the same conditions as Example 1 except for the fact that straight chain low density polyethylene manufactured using a metallocene catalyst and having the characteristics shown in Table 1 (for example, a melting start temperature of 95° C.) was used as the high molecular matrix.

Example 3

A PTC thermistor was manufactured by the same procedures and under the same conditions as Example 1 except for the fact that straight chain low density polyethylene (melting point: 122° C., density: 925 kg/m$^3$) manufactured using a metallocene catalyst and serving as the high molecular matrix, polyethylene wax (melting point: 90° C.) serving as the low molecular organic compound, and filamentary nickel particles (average particle diameter: 0.7 μm) serving as the conductive particles were introduced into a mill in quantities of 40.0 volume percent, 25 volume percent, and 35 volume percent respectively, and then heat-kneaded for thirty minutes at a temperature of 150° C.

Example 4

A PTC thermistor was manufactured by the same procedures and under the same conditions as Example 1 except for the fact that straight chain low density polyethylene (melting point: 116° C., density: 915 kg/m$^3$) manufactured using a metallocene catalyst and serving as the high molecular matrix, an ethylene homopolymer having a branching ratio sum per molecule of between zero and three (melting point: 99° C.) and serving as the low molecular organic compound, and filamentary nickel particles (average particle diameter: 0.7 μm) serving as the conductive particles were introduced into a mill in quantities of 45.0 volume percent, 25 volume percent, and 30 volume percent respectively, and then heat-kneaded for thirty minutes at a temperature of 150° C.

Example 5

A PTC thermistor was manufactured by the same procedures and under the same conditions as Example 1 except for the fact that straight chain low density polyethylene manufactured using a metallocene catalyst and serving as the high molecular matrix, an ethylene homopolymer (melting point: 99° C., penetration at 25° C.: 2.0) serving as the low molecular organic compound, and filamentary nickel particles (average particle diameter: 2.5 μm) serving as the conductive particles were introduced into a mill in quantities of 45.0 volume percent, 25 volume percent, and 35 volume percent respectively, and then heat-kneaded for thirty minutes at a temperature of 150° C.

Example 6

A PTC thermistor was manufactured by the same procedures and under the same conditions as Example 1 except for the fact that straight chain low density polyethylene (melting start temperature: 85° C., density: 925 kg/m$^3$) manufactured using a metallocene catalyst and serving as the high molecular matrix, an ethylene homopolymer having a branching ratio sum per molecule of between zero and three and a penetration of two, and serving as the low molecular organic compound, and filamentary nickel particles (average particle diameter: 2.5 μm) serving as the conductive particles were introduced into a mill in quantities of 45.0 volume percent, 25 volume percent, and 35 volume percent respectively, and then heat-kneaded for thirty minutes at a temperature of 150° C.

Example 7 to Example 12

A PTC thermistor was manufactured by the same procedures and under the same conditions as Example 1 except for the fact that straight chain low density polyethylene manufactured using a metallocene catalyst and having the characteristics shown in Table 1 was used as the high molecular matrix, an ethylene homopolymer having the characteristics shown in Table 1 was used as the low molecular organic compound, and filamentary nickel particles having the characteristics shown in Table 1 were used as the conductive particles. Note that in the PTC thermistors of [Example 7] through [Example 12], the high molecular matrix content (volume percent), low molecular organic compound content (volume percent), and conductive particle content (volume percent) were set at the same values as those of the PTC thermistor in Example 1.

Example 13 to Example 20

A PTC thermistor was manufactured by the same procedures and under the same conditions as Example 1 except for the fact that polyethylene having the characteristics shown in Table 2 was used as the high molecular matrix, an ethylene homopolymer having the characteristics shown in Table 2 was used as the low molecular organic compound, and filamentary nickel particles having the characteristics shown in Table 1 were used as the conductive particles. Note that in the PTC thermistors of [Example 13] through [Example 20], the high molecular matrix content (volume percent), low molecular organic compound content (volume percent), and conductive particle content (volume percent) were set at the same values as those of the PTC thermistor in Example 1.

Example 21

A PTC thermistor was manufactured by the same procedures and under the same conditions as Example 1 except for the fact that low density polyethylene having the characteristics shown in Table 2 was used as the high molecular matrix, an ethylene homopolymer having the characteristics shown in Table 2 was used as the low molecular organic compound, and filamentary nickel particles having the characteristics shown in Table 1 were used as the conductive particles. Note that in the PTC thermistor of [Example 21], the high molecular matrix content (volume percent), low molecular organic compound content (volume percent), and conductive particle content (volume percent) were set at the same values as those of the PTC thermistor in Example 1.

Example 22

A PTC thermistor was manufactured by the same procedures and under the same conditions as Example 1 except for the fact that straight chain low density polyethylene manufactured using a metallocene catalyst and having the characteristics shown in Table 2 was used as the high molecular matrix, an ethylene homopolymer having the characteristics shown in Table 2 was used as the low molecular organic compound, and filamentary nickel particles having the characteristics shown in Table 1 were used as the conductive particles. Note that in the PTC thermistor of [Example 22], the high molecular matrix content (volume percent), low molecular organic compound content (volume percent), and conductive particle content (volume percent) were set at the same values as those of the PTC thermistor in Example 1.

Comparative Example 1

A PTC thermistor was manufactured by the same procedures and under the same conditions as Example 1 except for the fact that polyethylene having the characteristics shown in Table 2 was used as the high molecular matrix, an ethylene homopolymer having the characteristics shown in Table 2 was used as the low molecular organic compound, and filamentary nickel particles having the characteristics shown in Table 1 were used as the conductive particles. Note that in the PTC thermistor of [Comparative Example 1], the high molecular matrix content (volume percent), low molecular organic compound content (volume percent), and conductive particle content (volume percent) were set at the same values as those of the PTC thermistor in Example 1.

[Thermal Shock Test]

A thermal shock test based on the provisions of JIS C 0025 was then performed on the PTC thermistors of Example 1 through Example 22 and Comparative Example 1, manufactured as described above, and the resistance value after the test was measured. More specifically, a single thermal processing cycle comprising the aforementioned steps (i) through (iv) was performed 200 times on each PTC thermistor, and the resulting resistance value {measured at room temperature (25° C.)} was measured. The results are shown in Table 1 and Table 2. Note that in Tables 1 and 2, the initial resistance value of each PTC thermistor at room temperature (25° C.) before performing the thermal shock test was confirmed as being no more than 0.03Ω. Further, devices having the product names "TSE-11-A" and "TSA-71H-W", manufactured by ESPEC CORP., were used as the devices for performing the thermal shock test.

Figure 5:
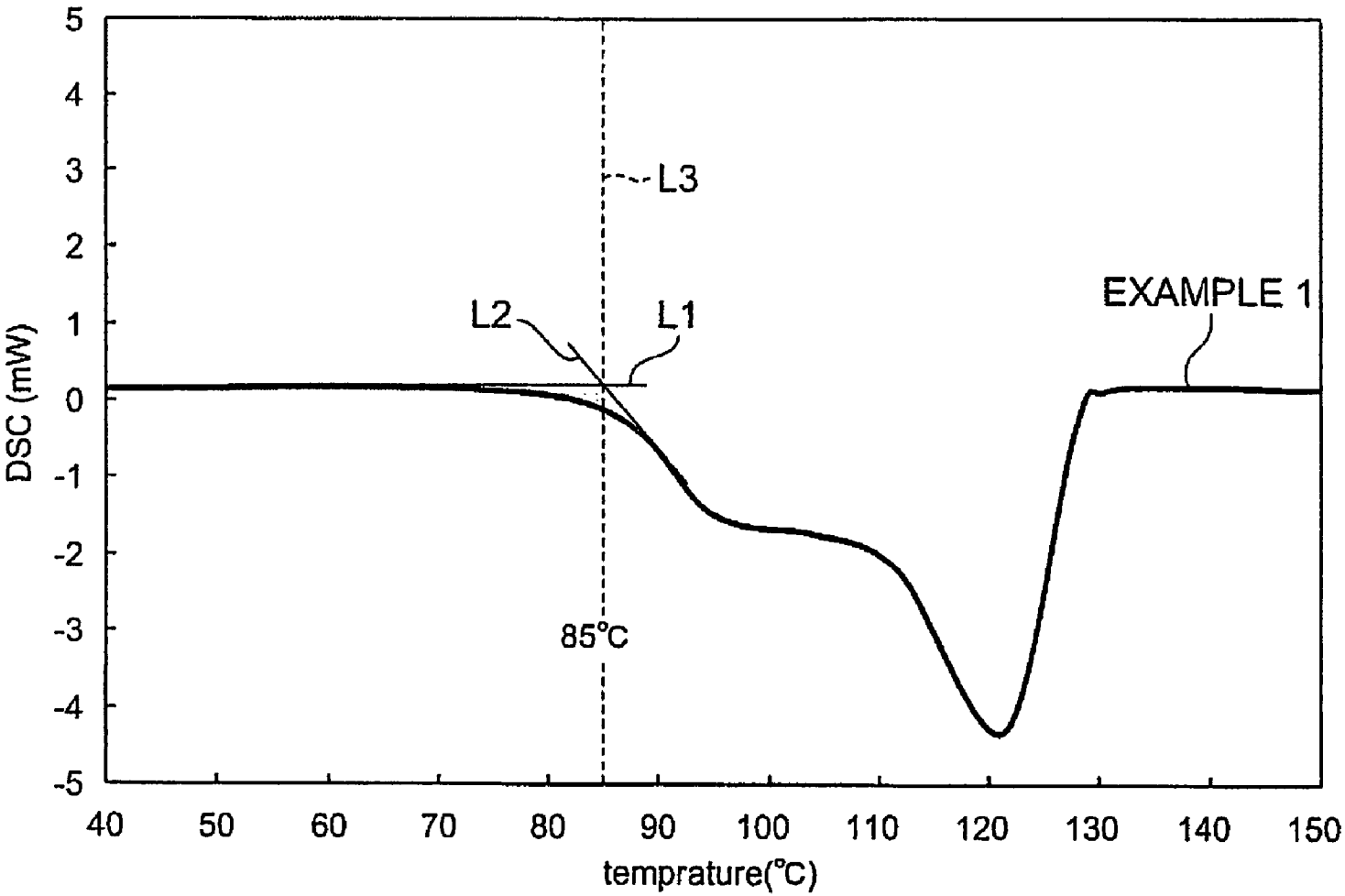
FIG. 5 is a graph showing a DSC curve of a high molecular matrix contained in a PTC thermistor of a first example.
Figure 6:
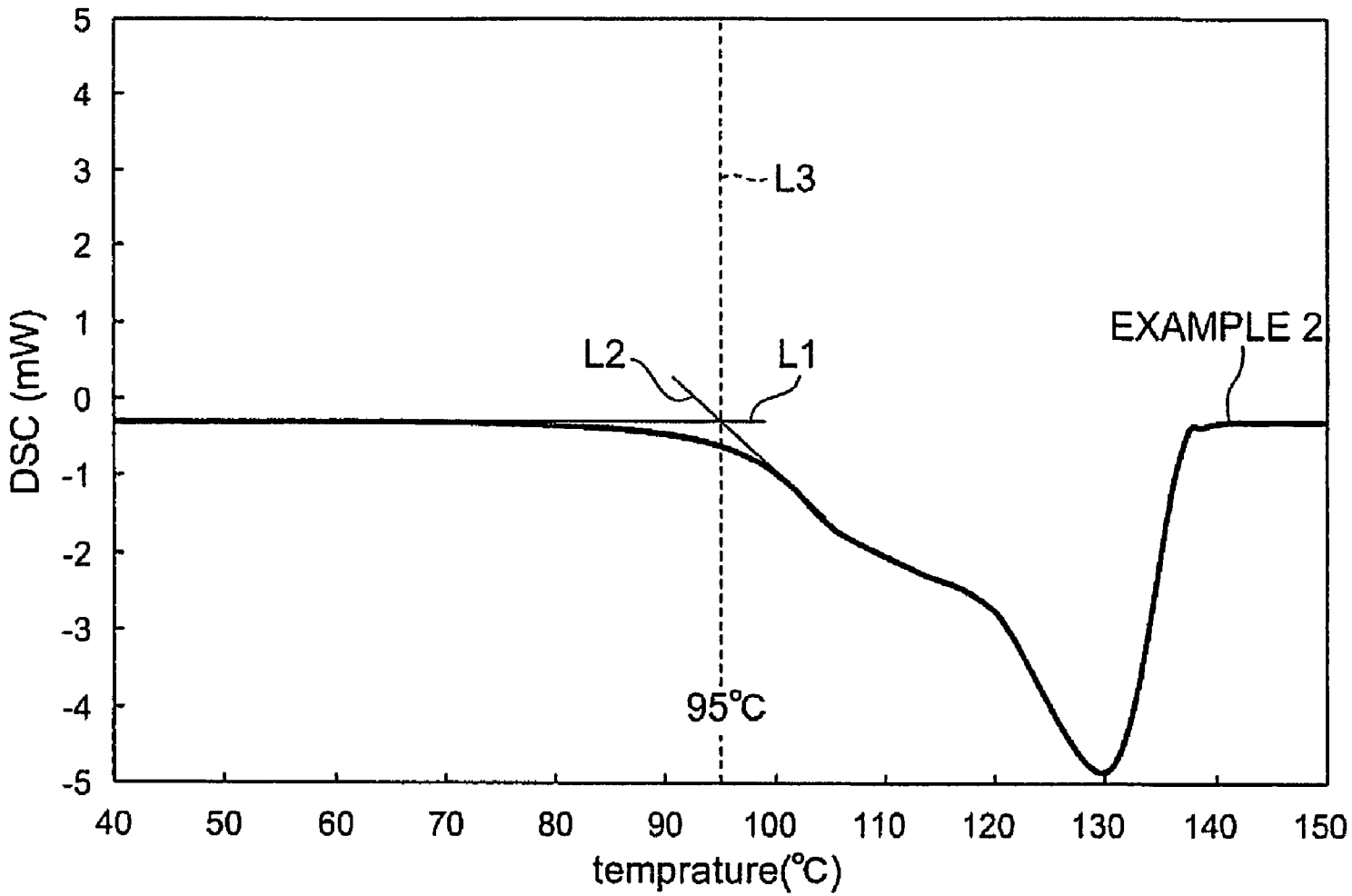
FIG. 6 is a graph showing a DSC curve of a high molecular matrix contained in a PTC thermistor of a second example.

Further, as described above, the melting start temperature of the high molecular matrix contained in each of the thermistors shown in Tables 1 and 2 was determined using a DSC curve obtained upon analysis by means of differential scanning calorimetry (DSC) using the high molecular matrix as a test sample. This will now be described using FIGS. 5 and 6. FIG. 5 is a graph showing the DSC curve of the high molecular matrix contained in the PTC thermistor of Example 1. FIG. 6 is a graph showing the DSC curve of the high molecular matrix contained in the PTC thermistor of Example 2.

In the PTC thermistor of Example 1 shown in FIG. 5 and the PTC thermistor of Example 2 shown in FIG. 6, the temperature at the intersecting point between a tangent L1 of a point of inflection appearing at the lowest temperature side of the first endothermic peak on the respectively obtained DSC curves and a baseline {a straight line indicating a differential scanning calorific value of 0 mW, which is parallel to the temperature axis (abscissa)} L2 is set as the melting start temperature.

A differential scanning calorimetry device (manufactured by Shimadzu Corporation, product name "DSC-50") was used for the differential scanning calorimetry. The measurement conditions were set as follows: rate of temperature increase: 2° C./min; test sample amount: 19.8 mg; cell for storing sample: aluminum cell; atmospheric gas: air (flow rate: 20 mL/min); reference material (a thermally stable substance): $\alpha$-$Al_2O_3$ powder.

Measurement of the linear expansion coefficient of the high molecular matrix contained in each of the thermistors in Tables 1 and 2 was performed according to the following procedure. The high molecular matrix serving as a test sample was formed into a rectangle with a thickness of 0.8 mm, a width of 10 mm, and a length of 30 mm. A linear expansion coefficient measuring device (manufactured by Seiko Instruments Inc., product name "TMASS6100") was used. The two ends of the rectangular sample in the longitudinal direction were chucked to a jig, whereupon measurement of the tensile mode in the longitudinal direction was performed. The measurement temperature was varied within a range of −40 to 85° C., the oscillation frequency applied to the sample was set at 1 Hz, and variation in the length of the sample was measured. The linear expansion coefficient was then calculated from the obtained expansion curve within a temperature range (25 to 69° C.) at which the most stable straight line is obtained.

FIGS. 7 through 12 show graphs of the respective resistance-temperature characteristics of the PTC thermistors in Examples 7 through 12.

As for the operating temperature of each PTC thermistor, the surface temperature 100 seconds after a short circuit current was caused to flow following the application of a 6V voltage was measured as the operating temperature. As a result, the operating temperature of the PTC thermistor in Example 1 was 90° C., the operating temperature of the PTC thermistor in Example 2 was 95° C., the operating temperature of the PTC thermistor in Example 3 was 90° C., the operating temperature of the PTC thermistor in Example 4 was 90° C., the operating temperature of the PTC thermistor in Example 5 was 88° C., the operating temperature of the PTC thermistor in Example 6 was 90° C., the operating temperature of the PTC thermistor in Example 7 was 82° C., the operating temperature of the PTC thermistor in Example 8 was 88° C., the operating temperature of the PTC thermistor in Example 9 was 89° C., the operating temperature of the PTC thermistor in Example 10 was 90° C., the operating temperature of the PTC thermistor in Example 11 was 95° C., the operating temperature of the PTC thermistor in Example 12 was 100° C., the operating temperature of the PTC thermistor in Example 13 was 100° C., the operating temperature of the PTC thermistor in Example 14 was 99° C., the operating temperature of the PTC thermistor in Example 15 was 97° C., the operating temperature of the PTC thermistor in Example 16 was 95° C., the operating temperature of the PTC thermistor in Example 17 was 97° C., the operating temperature of the PTC thermistor in Example 18 was 95° C., the operating temperature of the PTC thermistor in Example 19 was 97° C., the operating temperature of the PTC thermistor in Example 20 was 90° C., the operating temperature of the PTC thermistor in Example 21 was 90° C., the operating temperature of the PTC thermistor in Example 22 was 95° C., and the operating temperature of the PTC thermistor in Comparative Example 1 was 80° C.

TABLE 1

Figure 7:
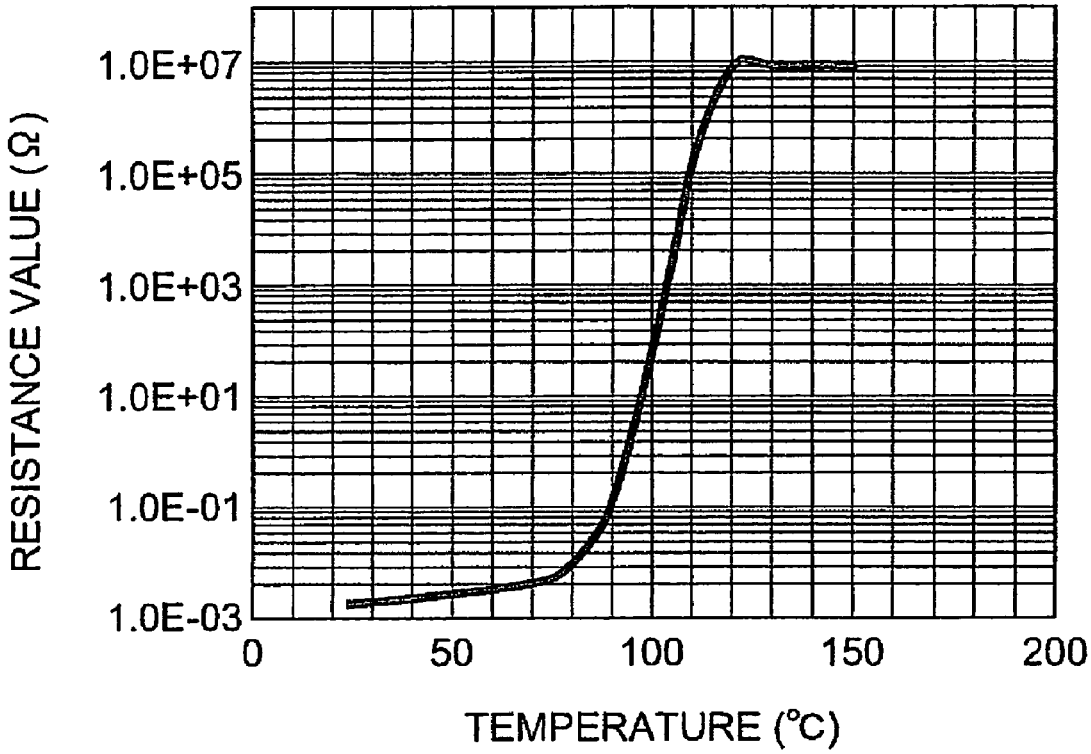
FIG. 7 is a graph showing the resistance-temperature characteristic of a PTC thermistor of a seventh example.
Figure 8:
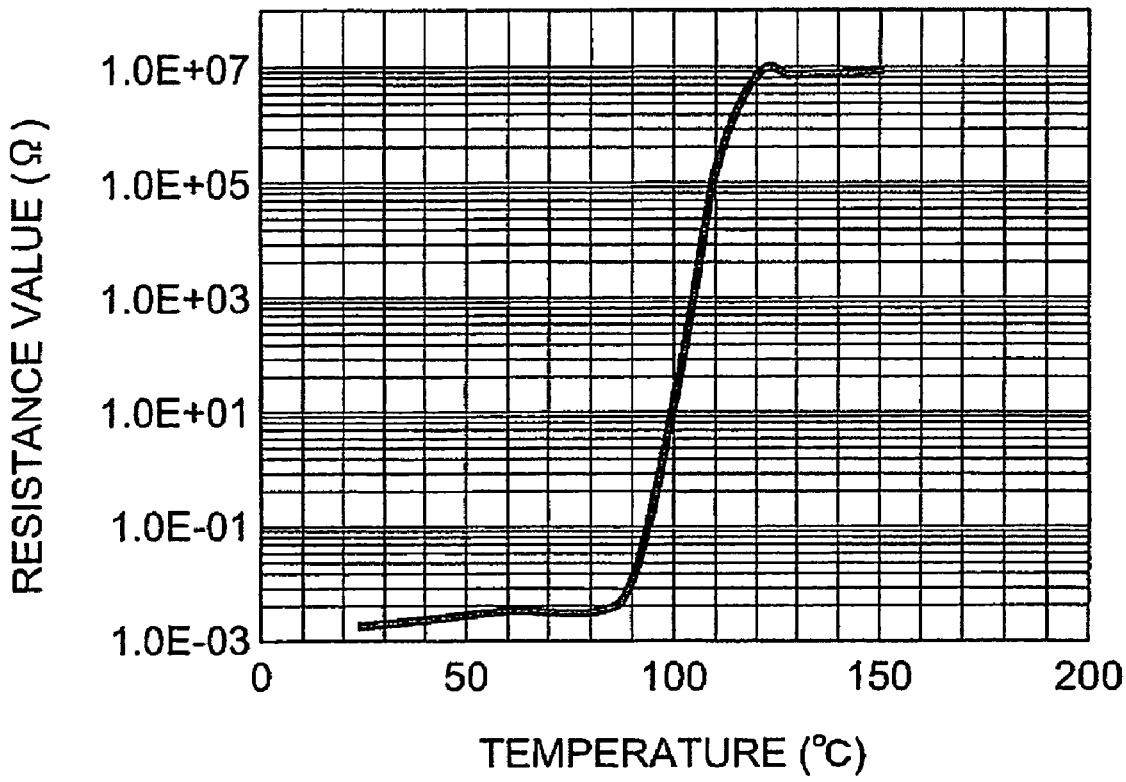
FIG. 8 is a graph showing the resistance-temperature characteristic of a PTC thermistor of an eighth example.
Figure 9:
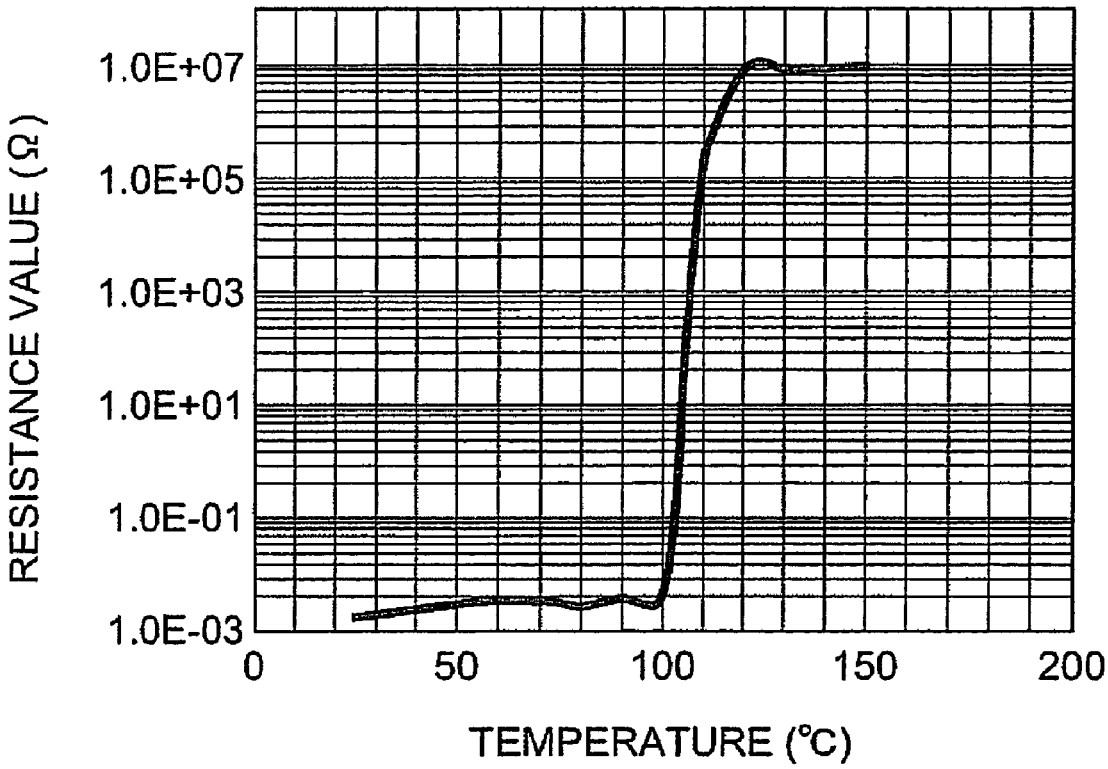
FIG. 9 is a graph showing the resistance-temperature characteristic of a PTC thermistor of a ninth example.
Figure 10:
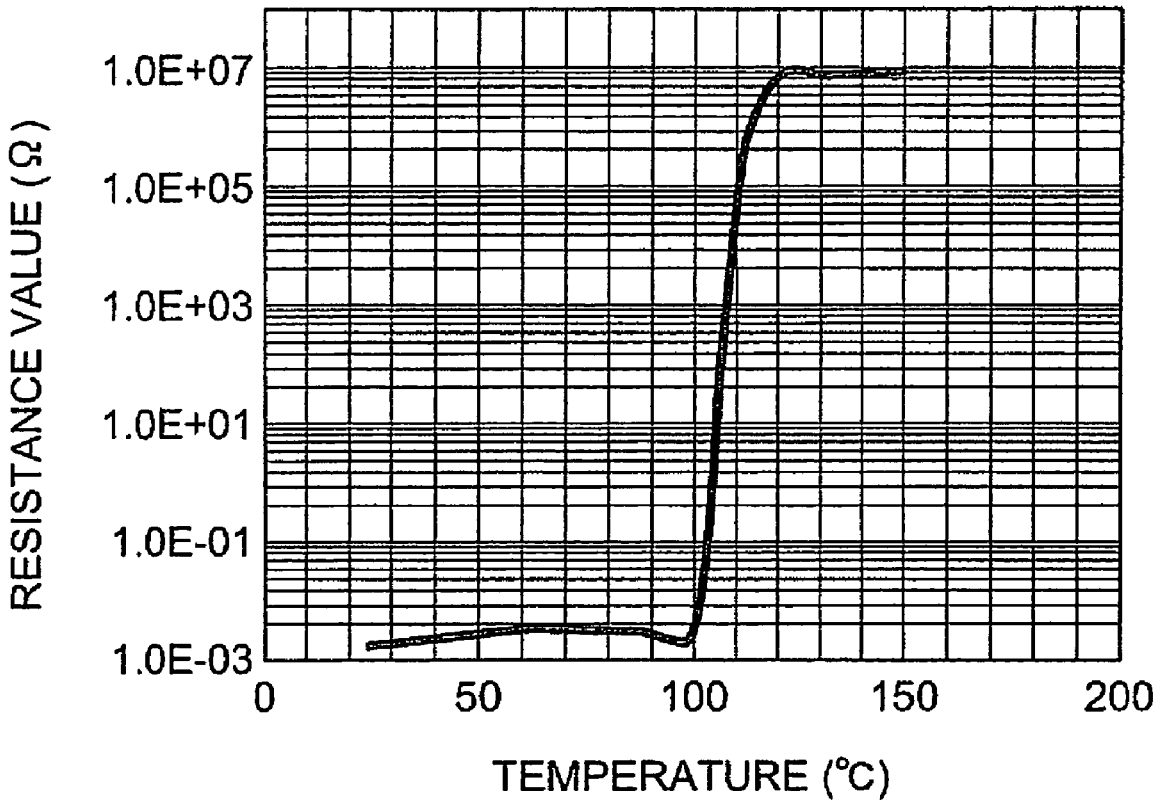
FIG. 10 is a graph showing the resistance-temperature characteristic of a PTC thermistor of a tenth example.
Figure 11:
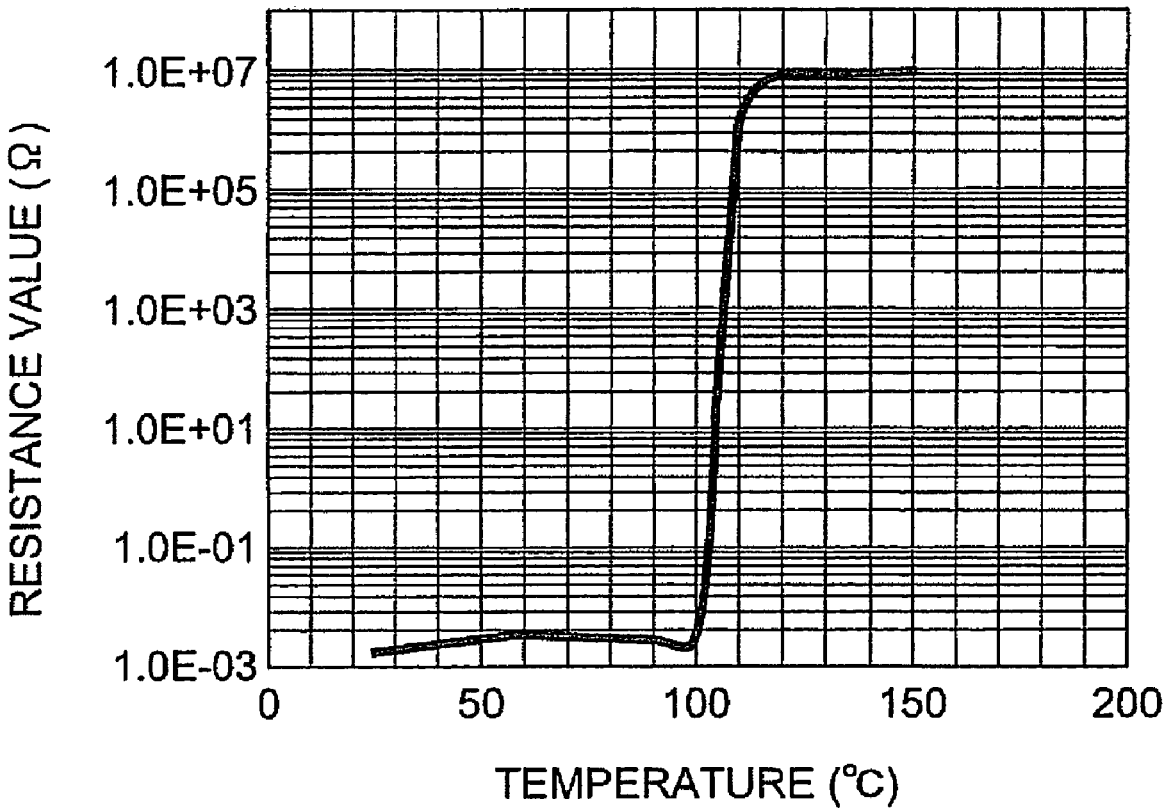
FIG. 11 is a graph showing the resistance-temperature characteristic of a PTC thermistor of an eleventh example.
Figure 12:
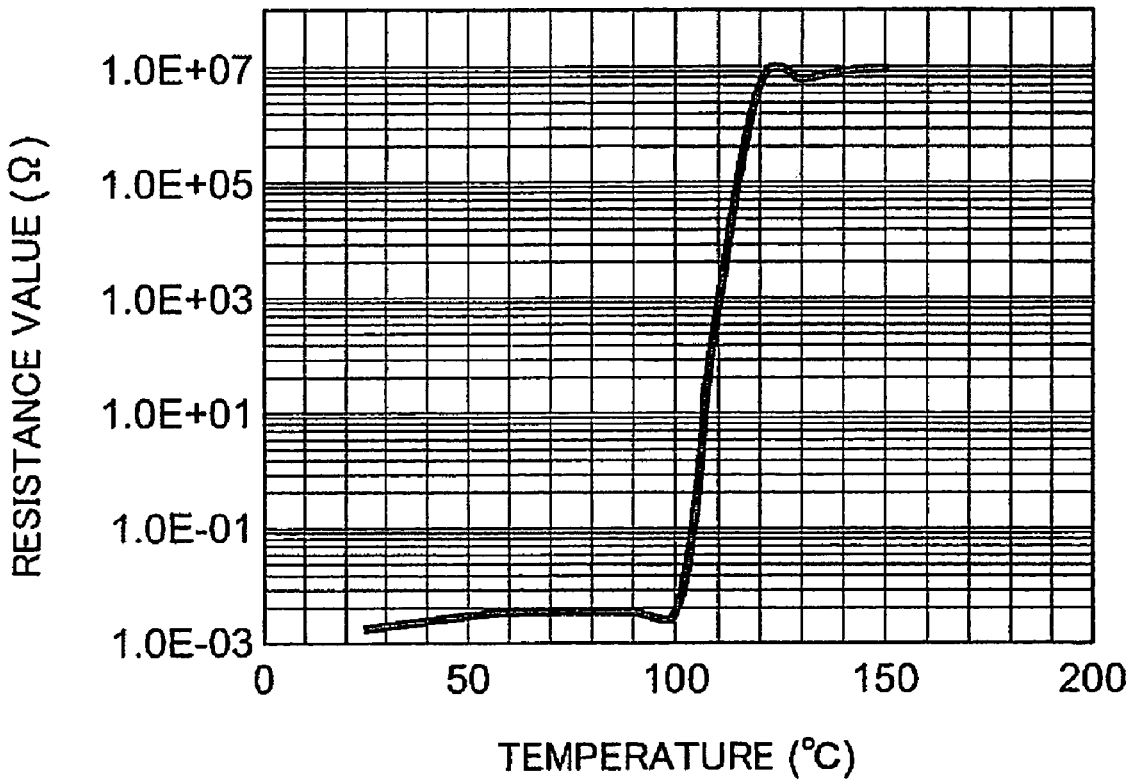
FIG. 12 is a graph showing the resistance-temperature characteristic of a PTC thermistor of a twelfth example.

| | HIGH MOLECULAR MATRIX | | | | LOW MOLECULAR ORGANIC COMPOUND | | | | FILAMENTARY PARTICLES OF Ni (CONDUCTIVE PARTICLES) | | RESISTANCE VALUE AFTER THERMAL SHOCK TEST (200 CYCLES)/Ω |
|---|---|---|---|---|---|---|---|---|---|---|---|
| | MELTING START TEMPERATURE/ ° C. | DENSITY/ Kg/m³ | COEFFICIENT OF LINEAR EXPANSION | MELTING POINT T1/° C. | PENETRATION | AVERAGE NUMBER OF BRANCHES PER MOLECULE | MELTING POINT T2/° C. | T1 − T2/ ° C. | AVERAGE PARTICLE DIAMETER/ μm | SPECIFIC SURFACE AREA/m²/g | |
| EXAMPLE1 | 85 | 925 | $4.08 \times 10^{-4}$ | 122 | 7 | 4-6 | 90 | 32 | 0.7 | 1.5-2.5 | 0.030 |
| EXAMPLE2 | 95 | 935 | $3.95 \times 10^{-4}$ | 130 | 7 | 4-6 | 90 | 40 | 0.7 | 1.5-2.5 | 0.030 |
| EXAMPLE3 | 85 | 925 | $4.08 \times 10^{-4}$ | 122 | 7 | 4-6 | 90 | 32 | 0.7 | 1.5-2.5 | 0.008 |
| EXAMPLE4 | 80 | 915 | $5.43 \times 10^{-4}$ | 116 | 2 | 0-3 | 99 | 17 | 0.7 | 1.5-2.5 | 0.030 |
| EXAMPLE5 | 85 | 915 | $5.43 \times 10^{-4}$ | 116 | 2 | 4-6 | 99 | 17 | 2.5 | 0.58 | 0.030 |
| EXAMPLE6 | 85 | 925 | $4.08 \times 10^{-4}$ | 122 | 2 | 0-3 | 90 | 32 | 0.7 | 0.58 | 0.002 |
| EXAMPLE7 | 83 | 920 | $4.30 \times 10^{-4}$ | 120 | 2 | 0-3 | 79.5 | 40.5 | 0.7 | 1.5-2.5 | NO MORE THAN 0.030 SEE FIG. 4 |
| EXAMPLE8 | 83 | 920 | $4.30 \times 10^{-4}$ | 120 | 2 | 0-3 | 88 | 32 | 0.7 | 1.5-2.5 | NO MORE THAN 0.030 SEE FIG. 5 |
| EXAMPLE9 | 83 | 920 | $4.30 \times 10^{-4}$ | 120 | 2 | 0-3 | 99 | 21 | 0.7 | 1.5-2.5 | NO MORE THAN 0.030 SEE FIG. 6 |
| EXAMPLE10 | 83 | 920 | $4.30 \times 10^{-4}$ | 120 | 2 | 0-3 | 104 | 16 | 0.7 | 1.5-2.5 | NO MORE THAN 0.030 SEE FIG. 7 |
| EXAMPLE11 | 83 | 920 | $4.30 \times 10^{-4}$ | 120 | 2 | 0-3 | 107 | 13 | 0.7 | 1.5-2.5 | NO MORE THAN 0.030 SEE FIG. 8 |
| EXAMPLE12 | 83 | 920 | $4.30 \times 10^{-4}$ | 120 | 2 | 0-3 | 113 | 7 | 0.7 | 1.5-2.5 | NO MORE THAN 0.030 SEE FIG. 9 |

TABLE 2

| | HIGH MOLECULAR MATRIX | | | | LOW MOLECULAR ORGANIC COMPOUND | | | | FILAMENTARY PARTICLES OF Ni (CONDUCTIVE PARTICLES) | | RESISTANCE VALUE AFTER THERMAL SHOCK TEST (200 CYCLES)/Ω |
|---|---|---|---|---|---|---|---|---|---|---|---|
| | MELTING START TEMPERATURE/ ° C. | DENSITY/ Kg/m$^3$ | COEFFICIENT OF LINEAR EXPANSION | MELTING POINT T1/° C. | PENETRATION | AVERAGE NUMBER OF BRANCHES PER MOLECULE | MELTING POINT T2/° C. | T1 − T2/ ° C. | AVERAGE PARTICLE DIAMETER/ μm | SPECIFIC SURFACE AREA/m$^2$/g | |
| EXAMPLE13 | 115 | 965 | $1.00 \times 10^{-4}$ | 138 | 7 | 4-6 | 90 | 48 | 2.5 | 0.58 | 0.020 |
| EXAMPLE14 | 112 | 961 | $3.08 \times 10^{-4}$ | 136 | 7 | 4-6 | 90 | 46 | 2.5 | 0.58 | 0.020 |
| EXAMPLE15 | 100 | 956 | $3.53 \times 10^{-4}$ | 128 | 7 | 4-6 | 90 | 38 | 2.5 | 0.58 | 0.020 |
| EXAMPLE16 | 85 | 926 | $3.89 \times 10^{-4}$ | 122 | 7 | 4-6 | 90 | 32 | 2.5 | 0.58 | 0.020 |
| EXAMPLE17 | 95 | 935 | $3.95 \times 10^{-4}$ | 130 | 7 | 4-6 | 90 | 40 | 2.5 | 0.58 | 0.020 |
| EXAMPLE18 | 85 | 925 | $4.08 \times 10^{-4}$ | 122 | 7 | 4-6 | 90 | 32 | 2.5 | 0.58 | 0.020 |
| EXAMPLE19 | 95 | 922 | $5.38 \times 10^{-4}$ | 115 | 7 | 4-6 | 90 | 25 | 2.5 | 0.58 | 0.030 |
| EXAMPLE20 | 80 | 915 | $5.43 \times 10^{-4}$ | 116 | 7 | 4-6 | 90 | 26 | 2.5 | 0.58 | 0.030 |
| EXAMPLE21 | 80 | 915 | $5.43 \times 10^{-4}$ | 116 | 2 | 0-3 | 88 | 28 | 0.7 | 1.5-2.5 | 0.030 |
| EXAMPLE22 | 85 | 925 | $4.08 \times 10^{-4}$ | 122 | 2 | 0-3 | 90 | 32 | 0.7 | 1.5-2.5 | 0.001 |
| COMPARATIVE EXAMPLE1 | 73 | 902 | $6.03 \times 10^{-4}$ | 93 | 7 | 4-6 | 90 | 3 | 2.5 | 0.58 | 1.1 |

As can be seen from the results shown in Tables 1 and 2, the PTC thermistors of Examples 1 through 22 have a resistance value following the thermal shock test of no more than 0.03Ω, and are capable of sufficiently maintaining the suitably low resistance value obtained during the initial stage of usage even when operated repeatedly at an operating temperature of 100° C. or less. Hence the PTC thermistors were confirmed as having excellent reliability.

Example 23

(Preliminary Dispersion Step)

Straight chain low density polyethylene (melting point: 122° C., specific gravity: 0.92, number average molecular weight: 36,000) obtained through a polymerization reaction using a metallocene catalyst and serving as the high molecular matrix, an ethylene homopolymer (melting point: 90° C., number average molecular weight: 600) serving as the low molecular organic compound, and filamentary nickel particles (average particle diameter: 0.5 to 1.0 μm) serving as the conductive particles were weighed into quantities of 16 g, 9.6 g, and 107 g respectively, and then introduced into a round bottom flask with a volume of 1 L. Toluene (600 g) was then introduced into the flask as a solvent.

Here, the upper portion of the flask was connected to a cooling tube using water as a cooling fluid, thereby enabling the condensed toluene to circulate through the flask. Next, the flask was submerged in an oil bath regulated to a temperature of 125° C., whereupon the mixture inside the flask was stirred for one hour using a homomixer under a temperature condition of 125° C. Here, the toluene and polyethylene in the flask are completely mutually soluble, and hence after approximately 40 minutes from the start of heating, a black solution was obtained. After one hour from the start of heating, the heat switch of the oil bath was turned off, and the flask was left to cool naturally for approximately six hours while remaining submerged in the oil bath. After this natural cooling process, the black solution inside the flask had formed into a gel.

(Liquid Removing Step)

The flask was inserted into a vacuum dryer and dried for eight hours under a temperature condition of 90° C. As a result, the toluene solvent was completely removed from the gel inside the flask.

(Heat-Kneading Step)

The solid substance obtained in the liquid removal step was introduced into a mill and heat-kneaded for thirty minutes under a temperature condition of 150° C. The rotation speed of the mill at this time was set to 25 rpm.

(Molding Step)

The kneaded substance obtained following the heat-kneading step was molded into a sheet-form, whereupon the two sides of the kneaded substance were sandwiched between two sheets of nickel foil (thickness: 30 μm, joining surfaces with the molded body being roughened) serving as electrodes. A hot-press was then used to fix the molded body and the two sheets of nickel foil together under pressure at 150° C., thereby producing a molded object having an overall thickness of 0.3 mm and a diameter of 100 mm. The two sides of the molded object were then irradiated with electron beams under a condition of 20MRAD to promote a cross-linking reaction between the polymeric materials in the interior of the molded object and thereby stabilize the molded object thermally and mechanically, whereupon the molded object was stamped into an angled shape having length and breadth dimensions of 9 mm×3 mm. As a result, a PTC thermistor was obtained with a constitution in which the kneaded and molded sheet (thermistor element) comprising the low molecular organic compound, high molecular matrix, and conductive particles is disposed (sandwiched) between and fixed tightly to the two electrodes formed from nickel foil.

Comparative Example 2

A PTC thermistor was formed by the following procedures and under the following conditions without performing the preliminary dispersion step. First, straight chain low density polyethylene (melting point: 122° C., specific gravity: 0.91, number average molecular weight: 25,500) obtained through a polymerization reaction using a metallocene catalyst and serving as the high molecular matrix, an ethylene homopolymer (melting point: 90° C., number average molecular weight: 600) serving as the low molecular organic compound, and filamentary nickel particles (average particle diameter: 1.0 μm) serving as the conductive particles were introduced directly into a mill in quantities of 16 g, 9.6 g, and 107 g respectively, and then heat-kneaded for thirty minutes under a temperature condition of 150° C. The rotation speed of the mill at this time was set to 25 rpm. Thereafter, the PTC thermistor was formed by similar procedures and under similar conditions to those of Example 23.

[Thermal Shock Test]

A thermal shock test based on the provisions in JIS C 0025 was then performed on the PTC thermistors of Example 23 and Comparative Example 2, manufactured as described above, and the resistance value after the test was measured. More specifically, a single thermal processing cycle comprising the aforementioned steps (i) through (iv) was performed 200 times on each PTC thermistor, and the resulting resistance value {measured at room temperature (25° C.)} was measured. The results are shown in Table 3. Note that in Table 3, the "initial resistance value" denotes the resistance value of each PTC thermistor at 25° C. before performing the thermal shock test. Further, the product names "TSE-11-A" and "TSA-71H-W", manufactured by ESPEC CORP., were used as the devices for performing the thermal shock test.

TABLE 3

| | INITIAL RESISTANCE VALUE/Ω | REISISTANCE VALUE AFTER THERMAL SHOCK TEST(200 CYCLES)/Ω |
|---|---|---|
| EXAMPLE23 | 0.002 | 0.025 |
| COMPARATIVE EXAMPLE2 | 0.003 | 2.300 |

As can be seen from the results shown in Table 3, the PTC thermistor of Example 23 has a resistance value following the thermal shock test of no more than 0.03Ω, and is capable of sufficiently maintaining the suitably low resistance value obtained during an initial stage of usage even when operated repeatedly at an operating temperature of 100° C. or less. Hence this PTC thermistor was confirmed as having excellent reliability.

INDUSTRIAL APPLICABILITY

According to the present invention as described above, a PTC thermistor having excellent reliability, in which a resistance value obtained after a thermal shock test is no more than 0.03Ω, and the suitably low resistance value obtained during the initial stage of usage can be maintained sufficiently even after repeated operations at an operating temperature of 100° C. or less, can be obtained. Also according to the present invention, a manufacturing method for a PTC thermistor, according to which the highly reliable PTC thermistor having the characteristics described above, can be constructed easily and reliably, can be provided.

The invention claimed is:

1. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and said high molecular matrix is an olefin-type high molecular compound having a melting start temperature of between 85 and 95° C.;

wherein said high molecular matrix is polyethylene;

wherein said polyethylene is straight chain low density polyethylene obtained through a polymerization reaction using a metallocene catalyst; and wherein a melting point T1 [° C.] of said high molecular matrix and a melting point T2 [° C.] of said low molecular organic compound satisfy the condition denoted below as (A)

$$7° \text{ C.} \leqq (T1-T2) \leqq 40.5° \text{ C.} \qquad (A).$$

2. The PTC thermistor according to claim 1, characterized in that the density of said high molecular matrix is between 920 and 928 kg/m$^3$.

3. The PTC thermistor according to claim 1, characterized in that the coefficient of linear expansion of said high molecular matrix is between $1.0\times10^{-4}$ and $5.43\times10^{-4}$.

4. The PTC thermistor according to claim 1, characterized in that the penetration of said low molecular organic compound at 25° C. is between 0.5 and 6.5.

5. The PTC thermistor according to claim 1, characterized in that said low molecular organic compound is an ethylene homopolymer having a branching ratio sum of no more than three.

6. The PTC thermistor according to claim 1, characterized in that said conductive particles are filamentary particles constituted by nickel, said particles having a specific surface area of between 1.5 and 2.5 m$^2$/g.

7. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and the density of said high molecular matrix is between 920 and 928 kg/m$^3$;

wherein said high molecular matrix is polyethylene;

wherein said polyethylene is straight chain low density polyethylene obtained through a polymerization reaction using a metallocene catalyst; and wherein a melting point T1 [° C.] of said high molecular matrix and a melting point T2 [° C.] of said low molecular organic compound satisfy the condition denoted below as (A)

$$7° C. \leqq (T1-T2) \leqq 40.5° C. \quad (A).$$

8. The PTC thermistor according to claim 7, characterized in that the coefficient of linear expansion of said high molecular matrix is between $1.00\times10^{-4}$ and $5.43\times10^{-4}$.

9. The PTC thermistor according to claim 7, characterized in that the penetration of said low molecular organic compound at 25° C. is between 0.5 and 6.5.

10. The PTC thermistor according to claim 7, characterized in that said low molecular organic compound is an ethylene homopolymer having a branching ratio sum of no more than three.

11. The PTC thermistor according to claim 7, characterized in that said conductive particles are filamentary particles constituted by nickel, said particles having a specific surface area of between 1.5 and 2.5 $m^2/g$.

12. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and the coefficient of linear expansion of said high molecular matrix is between $1.00\times10^{-4}$ and $5.43\times10^{-4}$;

wherein said high molecular matrix is polyethylene;

wherein said polyethylene is straight chain low density polyethylene obtained through a polymerization reaction using a metallocene catalyst; and wherein a melting point T1 [° C.] of said high molecular matrix and a melting point T2 [° C.] of said low molecular organic compound satisfy the condition denoted below as (A)

$$7° C. \leqq (T1-T2) \leqq 40.5° C. \quad (A).$$

13. The PTC thermistor according to claim 12, characterized in that the penetration of said low molecular organic compound at 25° C. is between 0.5 and 6.5.

14. The PTC thermistor according to claim 12, characterized in that said low molecular organic compound is an ethylene homopolymer having a branching ratio sum of no more than three.

15. The PTC thermistor according to claim 12, characterized in that said conductive particles are filamentary particles constituted by nickel, said particles having a specific surface area of between 1.5 and 2.5 $m^2/g$.

16. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and the penetration of said low molecular organic compound at 25° C. is between 0.5 and 6.5;

wherein said high molecular matrix is polyethylene;

wherein said polyethylene is straight chain low density polyethylene obtained through a polymerization reaction using a metallocene catalyst; and wherein a melting point T1 [° C.] of said high molecular matrix and a melting point T2 [° C.] of said low molecular organic compound satisfy the condition denoted below as (A)

$$7° C. \leqq (T1-T2) \leqq 40.5° C. \quad (A).$$

17. The PTC thermistor according to claim 16, characterized in that said low molecular organic compound is an ethylene homopolymer having a branching ratio sum of no more than three.

18. The PTC thermistor according to claim 16, characterized in that said conductive particles are filamentary particles constituted by nickel, said particles having a specific surface area of between 1.5 and 2.5 $m^2/g$.

19. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and said low molecular organic compound is an ethylene homopolymer having a branching ratio sum of no more than three;

wherein said high molecular matrix is polyethylene;

wherein said polyethylene is straight chain low density polyethylene obtained through a polymerization reaction using a metallocene catalyst; and wherein a melting point T1 [° C.] of said high molecular matrix and a melting point T2 [° C.] of said low molecular organic compound satisfy the condition denoted below as (A)

$$7° C. \leqq (T1-T2) \leqq 40.5° C. \quad (A).$$

20. The PTC thermistor according to claim 19, characterized in that said conductive particles are filamentary particles constituted by nickel, said particles having a specific surface area of between 1.5 and 2.5 $m^2/g$.

21. A PTC thermistor comprising at least a pair of electrodes disposed so as to face each other, and a thermistor element disposed between said pair of electrodes and having a positive resistance-temperature characteristic, characterized in that said thermistor element is a molded body constituted by a high molecular matrix, a low molecular organic compound, and conductive particles having electric conductivity, the molecular weight of said high molecular matrix is between 10,000 and 400,000, the molecular weight of said low molecular organic compound is between 100 and 3,000, and a melting point T1 [° C.] of said high molecular matrix and a melting point T2 [° C.] of said low molecular organic compound satisfy the condition denoted below as (A); and $$7° \text{ C.} \leqq (T1-T2) \leqq 40.5° \text{ C.} \quad (A)$$

wherein said high molecular matrix is polyethylene;

wherein said polyethylene is straight chain low density polyethylene obtained through a polymerization reaction using a metallocene catalyst.

22. The PTC thermistor according to claim 21, characterized in that said conductive particles are filamentary particles constituted by nickel, and said particles have a specific surface area of between 1.5 and 2.5 $m^2/g$.

* * * * *